US011136979B2

(12) United States Patent
Moon et al.

(10) Patent No.: US 11,136,979 B2
(45) Date of Patent: Oct. 5, 2021

(54) SCROLL COMPRESSOR HAVING BUFFER MEMBER ARRANGED BETWEEN END OF SHAFT AND RECESS OF ECCENTRIC BUSH

(71) Applicant: Hanon Systems, Daejeon (KR)

(72) Inventors: Chi Myeong Moon, Daejeon (KR); In Cheol Shin, Daejeon (KR); Kweon Soo Lim, Daejeon (KR); Chang Eon Park, Daejeon (KR); Hyun Seong Ahn, Daejeon (KR); Soo Cheol Jeong, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 198 days.

(21) Appl. No.: 16/551,838

(22) Filed: Aug. 27, 2019

(65) Prior Publication Data

US 2020/0088198 A1 Mar. 19, 2020

(30) Foreign Application Priority Data

Sep. 14, 2018 (KR) ..... 1020180110154

(51) Int. Cl.
*F03C 2/00* (2006.01)
*F03C 4/00* (2006.01)
(Continued)

(52) U.S. Cl.
CPC ..... *F04C 29/0057* (2013.01); *F04C 18/0207* (2013.01); *F04C 18/063* (2013.01); *F04C 27/006* (2013.01)

(58) Field of Classification Search
CPC .. F04C 18/0215; F04C 18/063; F04C 27/006; F04C 29/00; F04C 29/0021; F04C 29/0057; F04C 29/06; F04C 29/063; F04C 29/065; F04C 2240/60; F04C 2240/807; F04C 2270/12; F04C 2270/13; F05C 2251/10
See application file for complete search history.

(56) References Cited

U.S. PATENT DOCUMENTS 5,562,436 A * 10/1996 Kawahara ..... F04C 29/0057 418/55.5
RE36,604 E * 3/2000 Sano ..... F04C 18/0215 418/55.1
(Continued)

FOREIGN PATENT DOCUMENTS

EP 3159544 A1 4/2017
JP H08021378 A 1/1996
(Continued)

*Primary Examiner* — Theresa Trieu
(74) *Attorney, Agent, or Firm* — Shumaker, Loop & Kendrick, LLP; James D. Miller

(57) ABSTRACT

A scroll compressor that includes a rotating shaft, an eccentric bush having a recess, into which one end of the shaft is inserted, and an eccentric portion eccentric to the shaft, an orbiting scroll operatively connected to the eccentric portion for orbiting, a fixed scroll engaged with the orbiting scroll, and a buffer member interposed between the one end of the shaft and the recess. Therefore, it is possible to prevent damage to the scrolls due to liquid refrigerant compression during initial operation and to prevent an impact sound between the shaft and the eccentric bush due to the rotational clearance therebetween.

15 Claims, 20 Drawing Sheets

(51) Int. Cl.

| | |
|---|---|
| ***F04C 18/00*** | (2006.01) |
| ***F04C 2/00*** | (2006.01) |
| ***F04C 29/00*** | (2006.01) |
| ***F04C 27/00*** | (2006.01) |
| ***F04C 18/063*** | (2006.01) |
| ***F04C 18/02*** | (2006.01) |

(56) References Cited

U.S. PATENT DOCUMENTS

| | | | | |
|---|---|---|---|---|
| 2003/0231815 | A1* | 12/2003 | Takayasu | F16C 33/02 384/279 |
| 2006/0153484 | A1* | 7/2006 | Ohata | F16C 33/7823 384/484 |
| 2014/0255231 | A1* | 9/2014 | Kii | F04C 18/0215 418/55.1 |
| 2015/0198161 | A1 | 7/2015 | Tozawa et al. | |

FOREIGN PATENT DOCUMENTS

| | | | | |
|---|---|---|---|---|
| JP | 2008208717 | A | | 9/2008 |
| JP | 2009127524 | A | * | 6/2009 |
| JP | 2010150944 | A | | 7/2010 |
| JP | 2012067602 | A | | 4/2012 |
| JP | 2020165394 | A | * | 10/2020 |

* cited by examiner

CONVENTIONAL ART

CONVENTIONAL ART

CONVENTIONAL ART

CONVENTIONAL ART

SCROLL COMPRESSOR HAVING BUFFER MEMBER ARRANGED BETWEEN END OF SHAFT AND RECESS OF ECCENTRIC BUSH

CROSS-REFERENCE TO RELATED APPLICATION

This patent application claims priority to Korean Patent Application No. 10-2018-0110154 filed Sep. 14, 2018, the entire disclosure of which is hereby incorporated herein by reference.

FIELD

Exemplary embodiments of the present disclosure relate to a scroll compressor, and more particularly, to a scroll compressor capable of compressing a refrigerant with a fixed scroll and an orbiting scroll.

BACKGROUND

In general, a vehicle is equipped with an air conditioning (A/C) system for cooling/heating the interior thereof. This air conditioning system includes a compressor that is a component of a cooling system and compresses the low-temperature and low-pressure gas-phase refrigerant, introduced from an evaporator, to a high-temperature and high-pressure gas-phase refrigerant to send it to a condenser.

Examples of the compressor include a reciprocating compressor that compresses a refrigerant according to which pistons reciprocate, and a rotary compressor that compresses a refrigerant while rotating. The reciprocating compressor includes a crank compressor that transmits a driving force from a drive source to a plurality of pistons using a crank, a swash plate compressor that transmits a driving force from a drive source to a shaft installed with a swash plate, and the like, according to the power transmission from the drive source. The rotary compressor includes a vane rotary compressor that utilizes a rotating rotary shaft and vane, and a scroll compressor that utilizes an orbiting scroll and a fixed scroll.

The scroll compressor has been widely used for refrigerant compression in the air conditioning system or the like since the scroll compressor is advantageous in that it can obtain a relatively higher compression ratio and a more stable torque by smoothly performing the suction, compression, and discharge strokes of refrigerant, compared to other compressors.

FIG. 1 is a cross-sectional view illustrating a conventional scroll compressor. FIG. 2 is an exploded perspective view illustrating a shaft and an eccentric bush in the scroll compressor of FIG. 1. FIG. 3 is a cross-sectional view illustrating a positional relationship between the shaft and the eccentric bush when the scroll compressor of FIG. 1 is normally operated. FIG. 4 is a cross-sectional view illustrating a state in which the eccentric bush of FIG. 3 is rotated about the shaft by the rotational clearance therebetween. FIG. 5 is a cross-sectional view illustrating a state in which the eccentric bush of FIG. 4 is further rotated about the shaft by the rotational clearance therebetween. FIG. 6 is a graph illustrating noise measured in the scroll compressor of FIG. 1.

Referring to FIGS. 1 and 2, the conventional scroll compressor includes a drive source 200 for generating a rotational force, a shaft 300 rotated by the drive source 200, an eccentric bush 400 having a recess 410, into which one end 310 of the shaft 300 is inserted, and an eccentric portion

420 eccentric to the shaft 300, an orbiting scroll 500 that orbits while communicating with the eccentric portion 420, and a fixed scroll 600 that defines a compression chamber together with the orbiting scroll 500.

Here, the eccentric bush 400 is configured such that a rotational clearance is present between an inner peripheral surface 412 of the recess 410 and an outer peripheral surface 312 of the one end 310 of the shaft 300, to prevent damage to the orbiting scroll 500 and the fixed scroll 600 due to liquid refrigerant compression, for example, as in initial operation. That is, the eccentric bush 400 is configured such that the rotational motion of the shaft 300 is not immediately transmitted to the eccentric bush 400 but is transmitted thereto in a buffered manner according to the designed rotational clearance. Thus, when the scroll compressor is normally operated, the eccentric bush 400 is rotated together with the shaft 300 in the state in which the recess 410 and the shaft 300 are concentric with each other, as illustrated in FIG. 3. However, for example, when the scroll compressor is initially operated, the eccentric bush 400 is rotated together with the shaft 300 in the state in which the eccentric bush 400 is rotated relative to the shaft 300 so that the radius of rotation of the eccentric bush 400 is adjusted, as illustrated in FIG. 4.

However, in such a conventional scroll compressor, for example, when the rotational speed of the shaft 300 is reduced or the rotation of the shaft 300 is interrupted, the bush 400 strikes the shaft 300 due to the rotational clearance as illustrated in FIG. 5. Hence, as illustrated in FIG. 6, an impact sound may occur and the noise and vibration of the compressor may be thus deteriorated.

SUMMARY

Accordingly, it is an object of the present disclosure to provide a scroll compressor capable of providing a rotational clearance between a shaft and an eccentric bush to prevent damage to scrolls due to liquid refrigerant compression during initial operation and of preventing an impact sound between the shaft and the eccentric bush due to the rotational clearance.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with an aspect of the present disclosure, there is provided a scroll compressor that includes a rotating shaft, an eccentric bush having a recess, into which one end of the shaft is inserted, and an eccentric portion eccentric to the shaft, an orbiting scroll operatively connected to the eccentric portion for orbiting, a fixed scroll engaged with the orbiting scroll, and a buffer member interposed between the one end of the shaft and the recess.

A buffer member's one end insertion groove may be formed on a tip surface of the one end of the shaft so that one end of the buffer member is inserted into the buffer member's one end insertion groove. A buffer member's other end insertion groove may be formed on a base surface of the recess facing the tip surface of the one end of the shaft so that the other end of the buffer member is inserted into the buffer member's other end insertion groove. A rotational clearance may be present between an inner peripheral surface of the recess and an outer peripheral surface of the one end of the shaft and between an inner peripheral surface of the buffer member's other end insertion groove and an outer peripheral surface of the other end of the buffer member. The rotational clearance may allow the outer peripheral surface of the other end of the buffer member to come into contact with the inner peripheral surface of the buffer member's other end insertion groove before the inner peripheral surface of the recess comes into contact with the outer peripheral surface of the one end of the shaft.

When the recess is located at a position concentric with the one end of the shaft, a gap between the inner peripheral surface of the recess and the outer peripheral surface of the one end of the shaft may be constant, a gap between the inner peripheral surface of the buffer member's other end insertion groove and the outer peripheral surface of the other end of the buffer member may be constant, and the gap between the inner peripheral surface of the buffer member's other end insertion groove and the outer peripheral surface of the other end of the buffer member may be smaller than the gap between the inner peripheral surface of the recess and the outer peripheral surface of the one end of the shaft.

The buffer member may be made of a material having a Shore hardness smaller than the buffer member's one end insertion groove and the buffer member's other end insertion groove.

The gap between the inner peripheral surface of the buffer member's other end insertion groove and the outer peripheral surface of the other end of the buffer member may be formed in proportion to the Shore hardness of the buffer member.

When assuming that the gap between the inner peripheral surface of the buffer member's other end insertion groove and the outer peripheral surface of the other end of the buffer member is G2 and the Shore hardness of the buffer member is H, they may be formed to satisfy a relation of $0<G2\leq(0.02$ mm/Shore hardness of 1 unit)*H−1.2 mm.

The buffer member may be made of a material having a Shore hardness of 70 units, and the gap between the inner peripheral surface of the buffer member's other end insertion groove and the outer peripheral surface of the other end of the buffer member may be greater than zero (0) and less than or equal to 0.2 mm.

The buffer member may be made of a material having a Shore hardness of 80 units, and the gap between the inner peripheral surface of the buffer member's other end insertion groove and the outer peripheral surface of the other end of the buffer member may be greater than zero (0) and less than or equal to 0.4 mm.

The inner peripheral surface of the buffer member's other end insertion groove may have a decreasing inner diameter in an axial direction from the tip surface of the one end of the shaft. When the recess is located at a position concentric with the one end of the shaft, a gap between the inner peripheral surface of the recess and the outer peripheral surface of the one end of the shaft may be constant, a gap between the inner peripheral surface of the buffer member's other end insertion groove and the outer peripheral surface of the other end of the buffer member may be constant, and the minimum gap between the inner peripheral surface of the buffer member's other end insertion groove and the outer peripheral surface of the other end of the buffer member may be smaller than the gap between the inner peripheral surface of the recess and the outer peripheral surface of the one end of the shaft.

The inner diameter of the inner peripheral surface of the buffer member's other end insertion groove may be linearly decreased in the axial direction from the tip surface of the one end of the shaft.

A tip surface of the other end of the buffer member may be spaced apart from a base surface of the buffer member's other end insertion groove.

A tip surface of the one end of the buffer member may be spaced apart from a base surface of the buffer member's one end insertion groove.

At least one of an inner peripheral surface of the buffer member's one end insertion groove and an outer peripheral surface of the one end of the buffer member may have an irregularity formed thereon to prevent separation of the buffer member from the buffer member's one end insertion groove.

The eccentric bush may further include a balance weight disposed on an opposite side of the eccentric portion with respect to the recess, a center of gravity of the balance weight may be formed on an opposite side of a center of the eccentric portion with respect to a center of the recess, and on an imaginary straight line connecting a center of the buffer member's other end insertion groove to the center of the recess and the center of gravity of the balance weight, the buffer member's other end insertion groove may be located between the center of the recess and the center of gravity of the balance weight.

The buffer member's other end insertion groove may be formed symmetrically with respect to the center of the buffer member's other end insertion groove.

When the recess is located at a position concentric with the one end of the shaft, the buffer member's one end insertion groove may face the buffer member's other end insertion groove and the buffer member's one end insertion groove may be formed symmetrically with respect to the center of the buffer member's one end insertion groove.

It is to be understood that both the foregoing general description and the following detailed description of the present disclosure are exemplary and explanatory and are intended to provide further explanation of the disclosure as claimed.

DRAWINGS

The above and other objects, features and other advantages of the present disclosure will be more clearly understood from the following detailed description taken in conjunction with the accompanying drawings, in which.

DETAILED DESCRIPTION

Hereinafter, a scroll compressor according to exemplary embodiments of the present disclosure will be described in detail with reference to the accompanying drawings.

Figure 1:
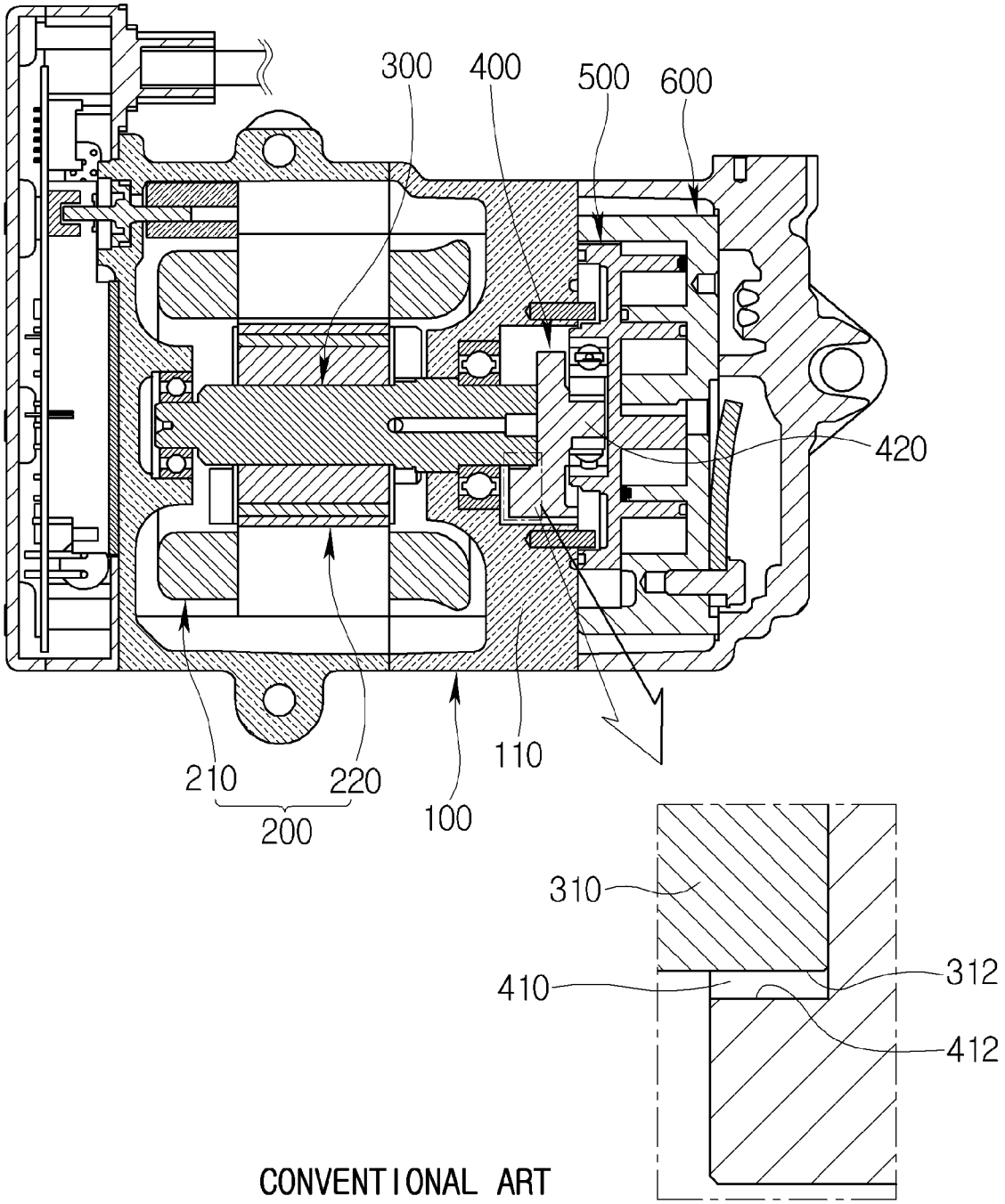
FIG. 1 is a cross-sectional view illustrating a conventional scroll compressor.
Figure 2:
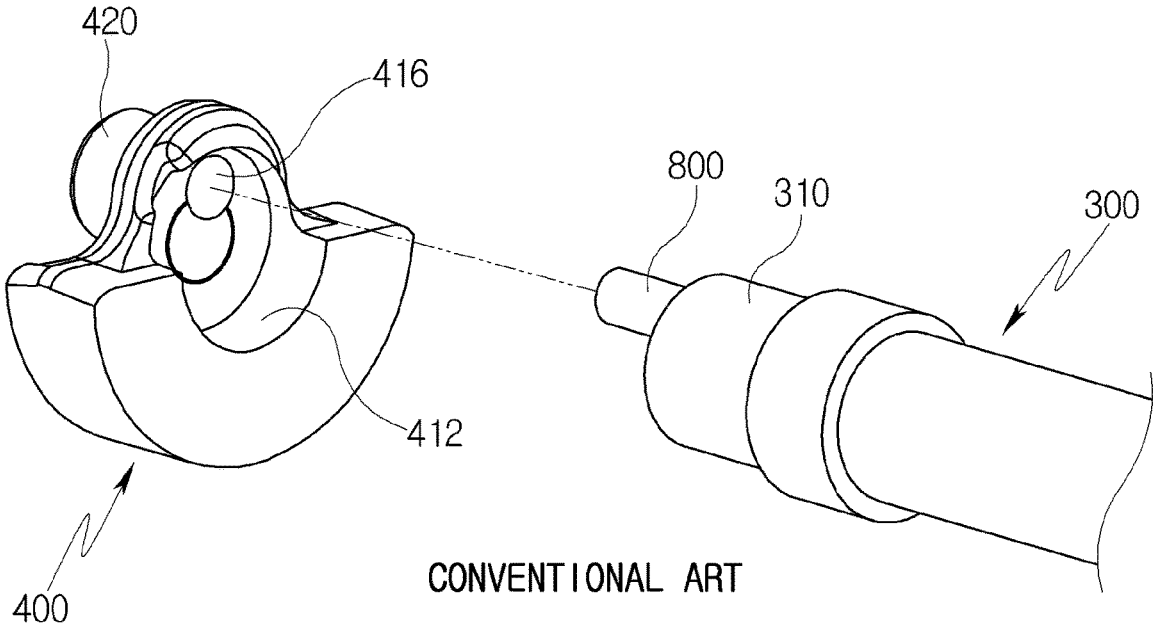
FIG. 2 is an exploded perspective view illustrating a shaft and an eccentric bush in the scroll compressor of FIG. 1.
Figure 3:
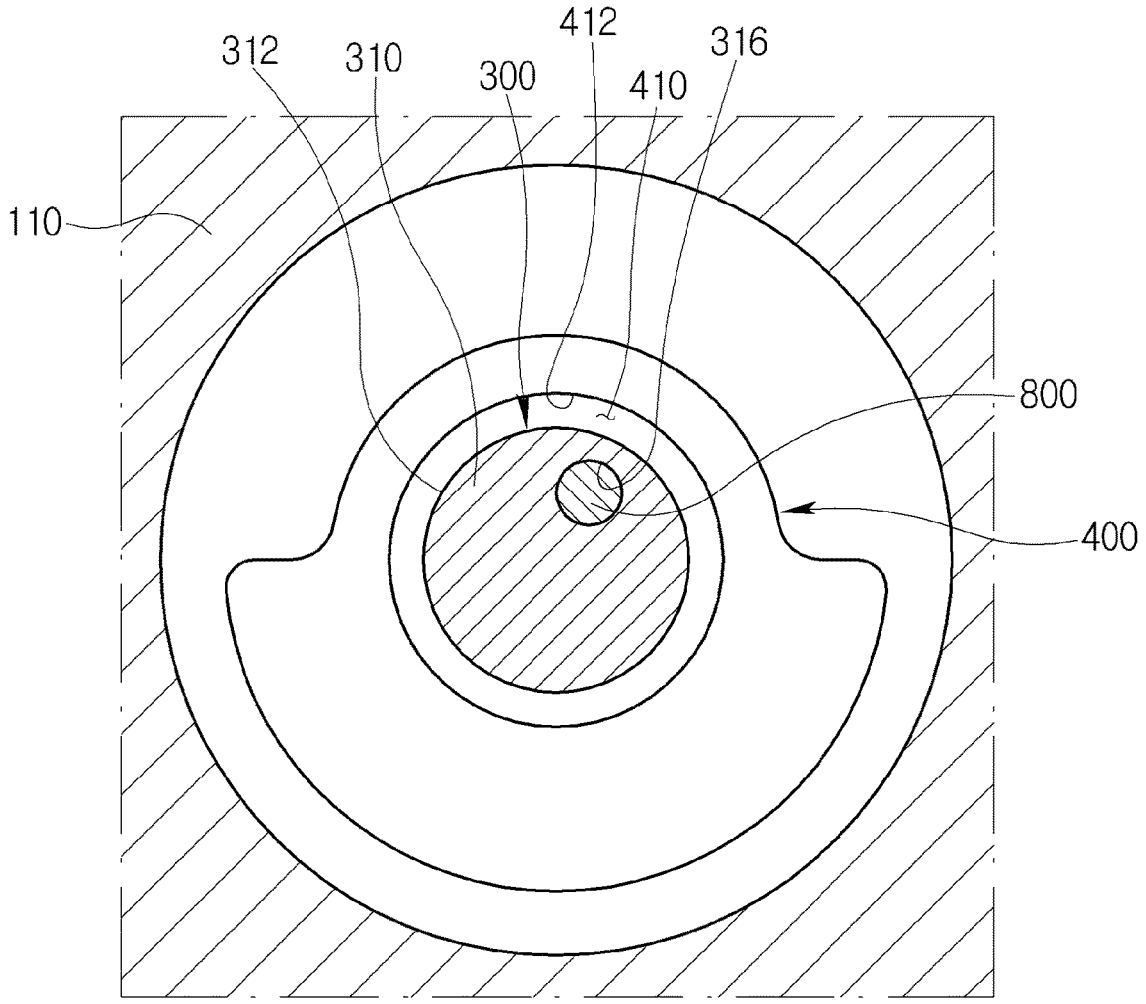
FIG. 3 is a cross-sectional view illustrating a positional relationship between the shaft and the eccentric bush when the scroll compressor of FIG. 1 is normally operated.
Figure 4:
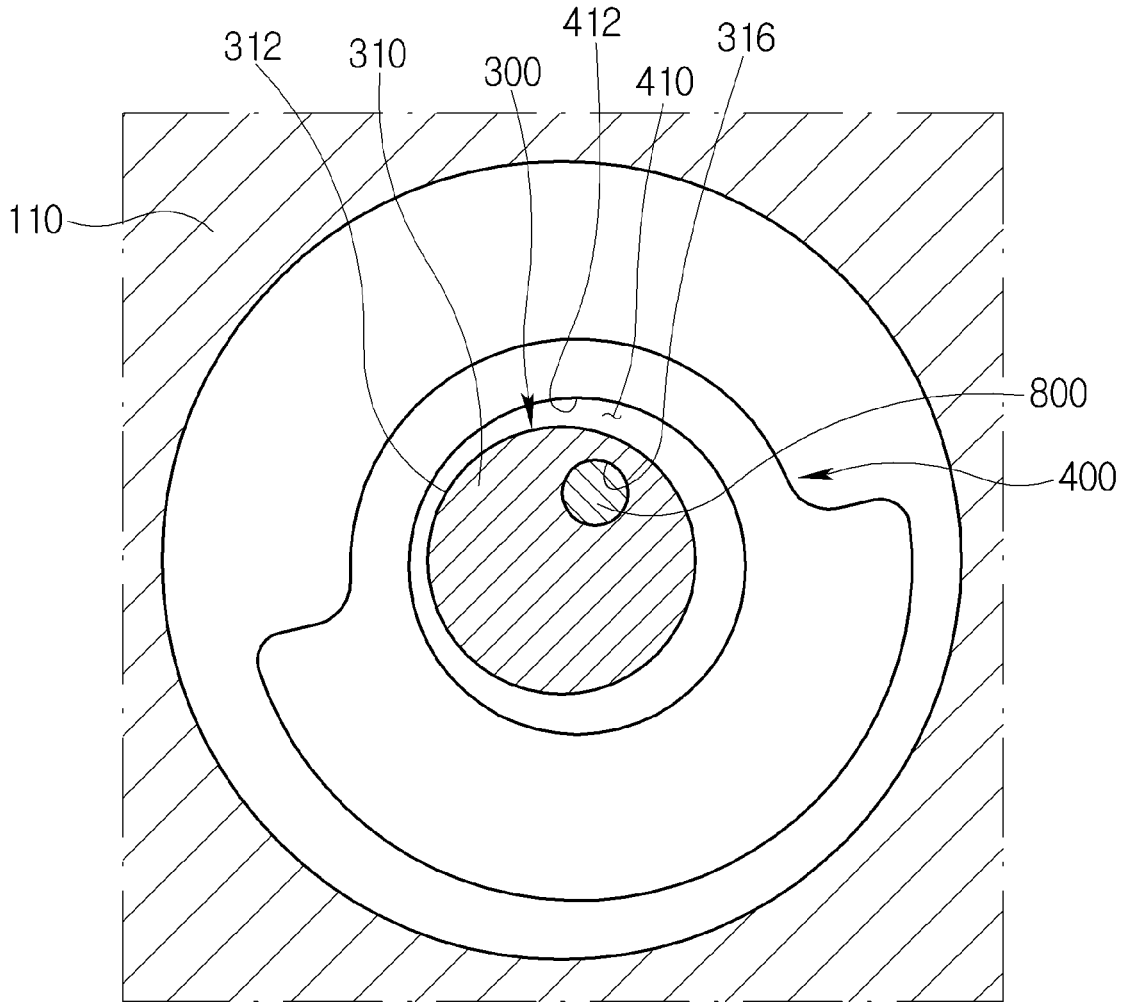
FIG. 4 is a cross-sectional view illustrating a state in which the eccentric bush of FIG. 3 is rotated about the shaft by the rotational clearance therebetween.
Figure 5:
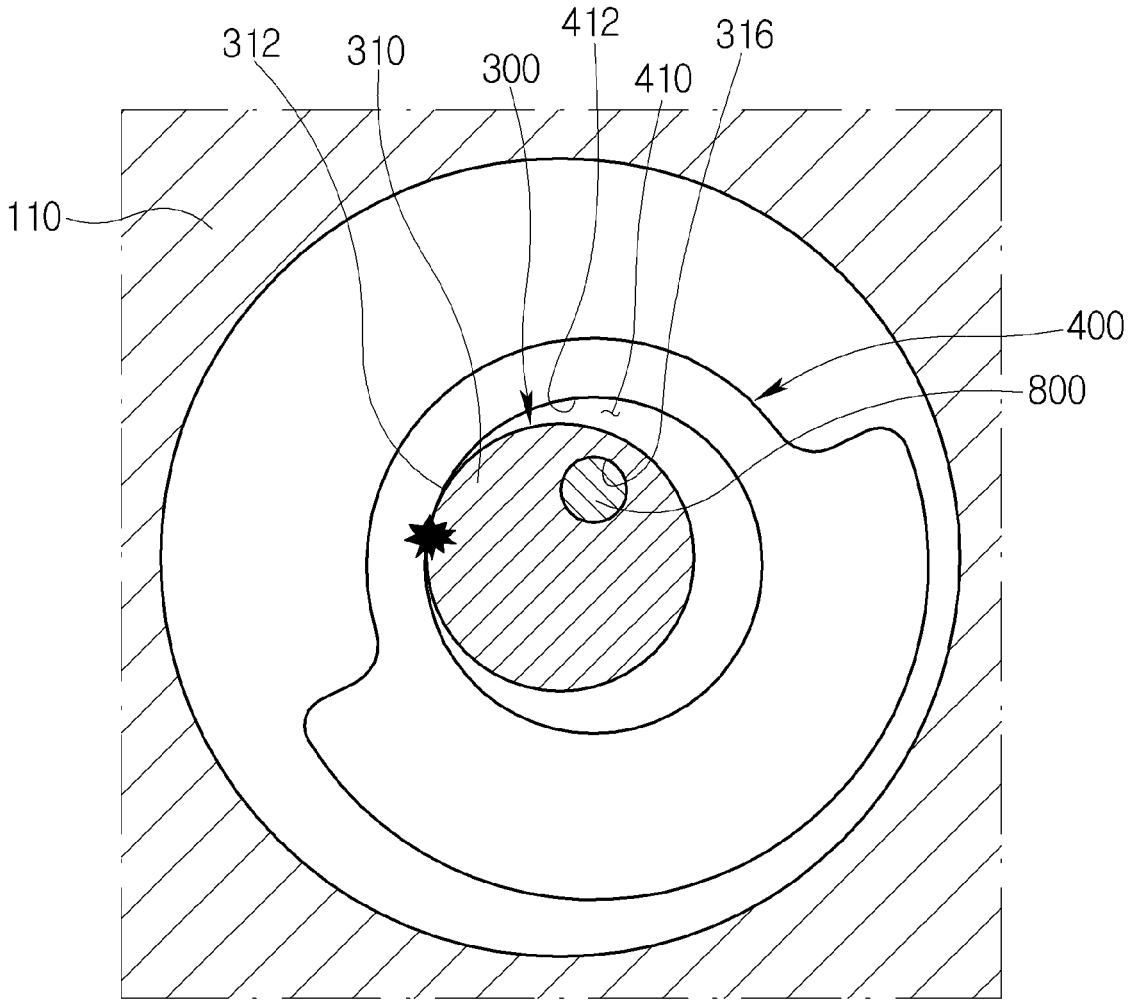
FIG. 5 is a cross-sectional view illustrating a state in which the eccentric bush of FIG. 4 is further rotated about the shaft by the rotational clearance therebetween.
Figure 6:
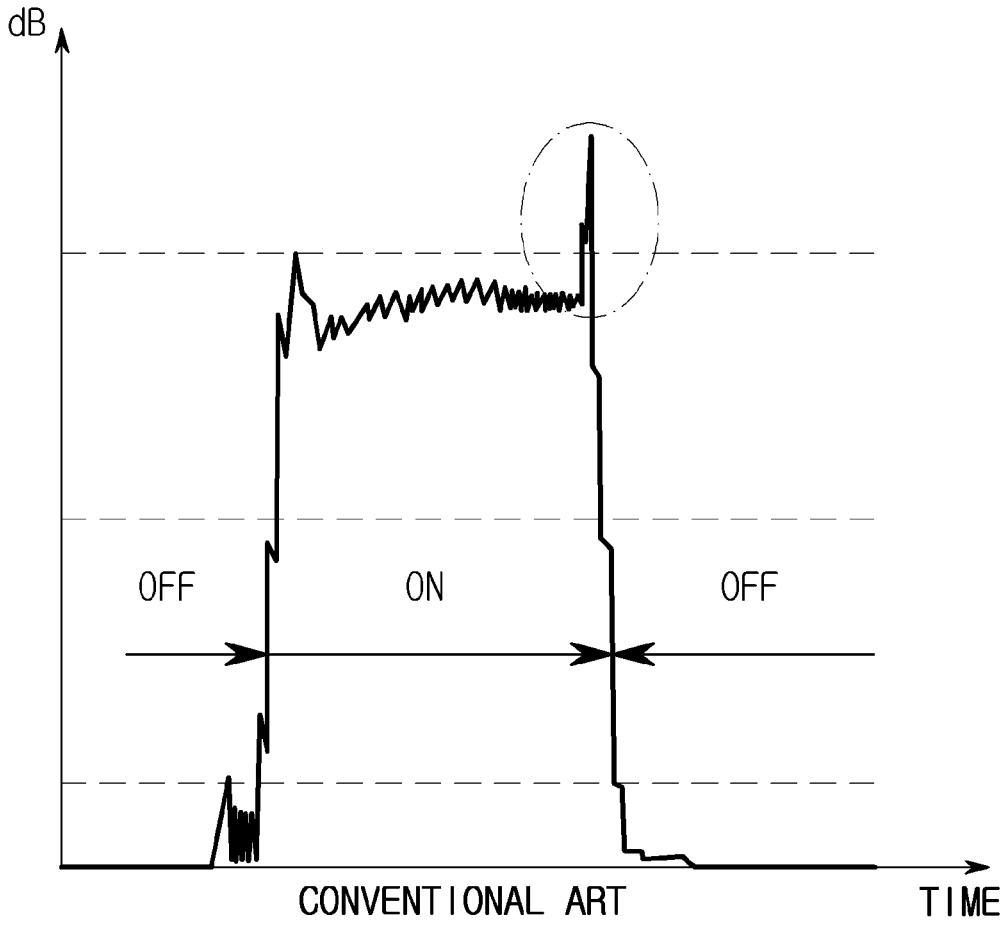
FIG. 6 is a graph illustrating noise measured in the scroll compressor of FIG. 1.
Figure 7:
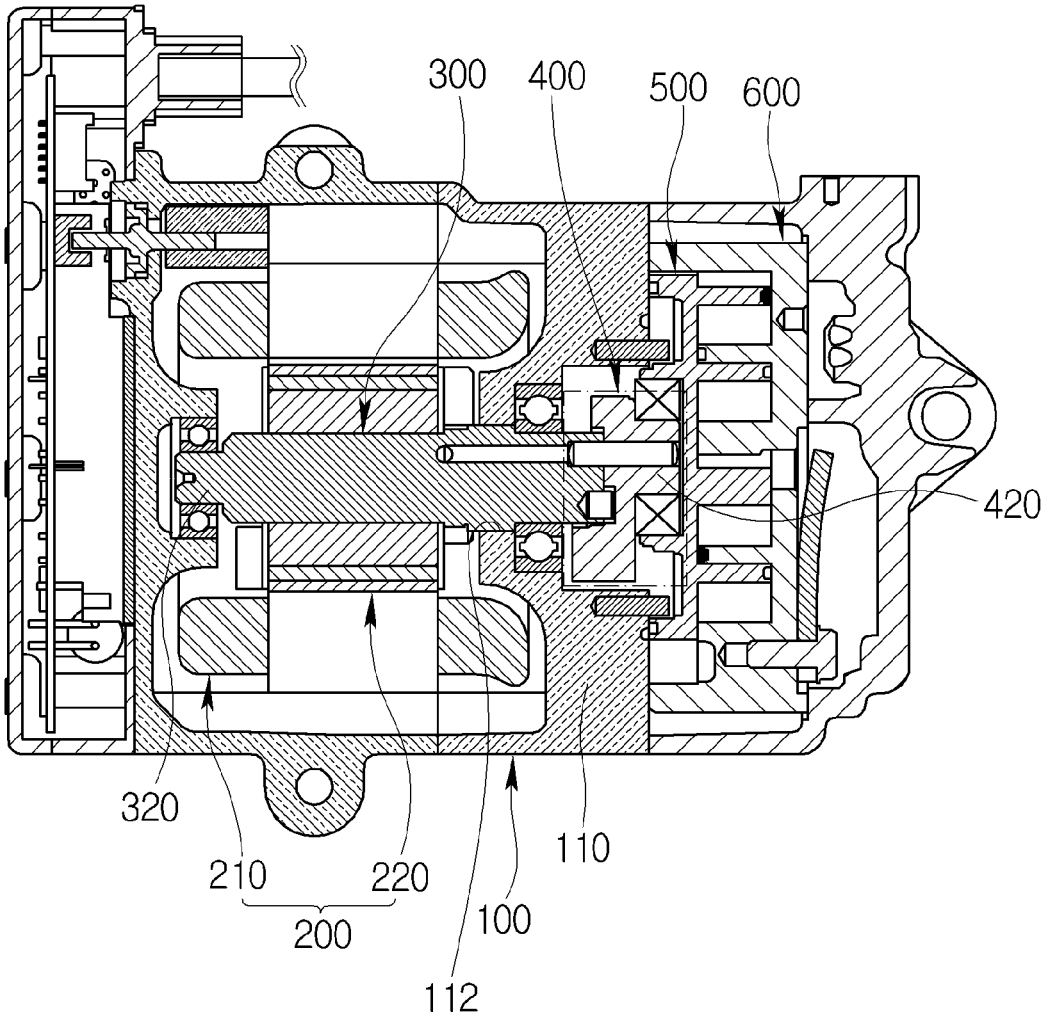
FIG. 7 is a cross-sectional view illustrating a scroll compressor according to an embodiment of the present disclosure.
Figure 8:
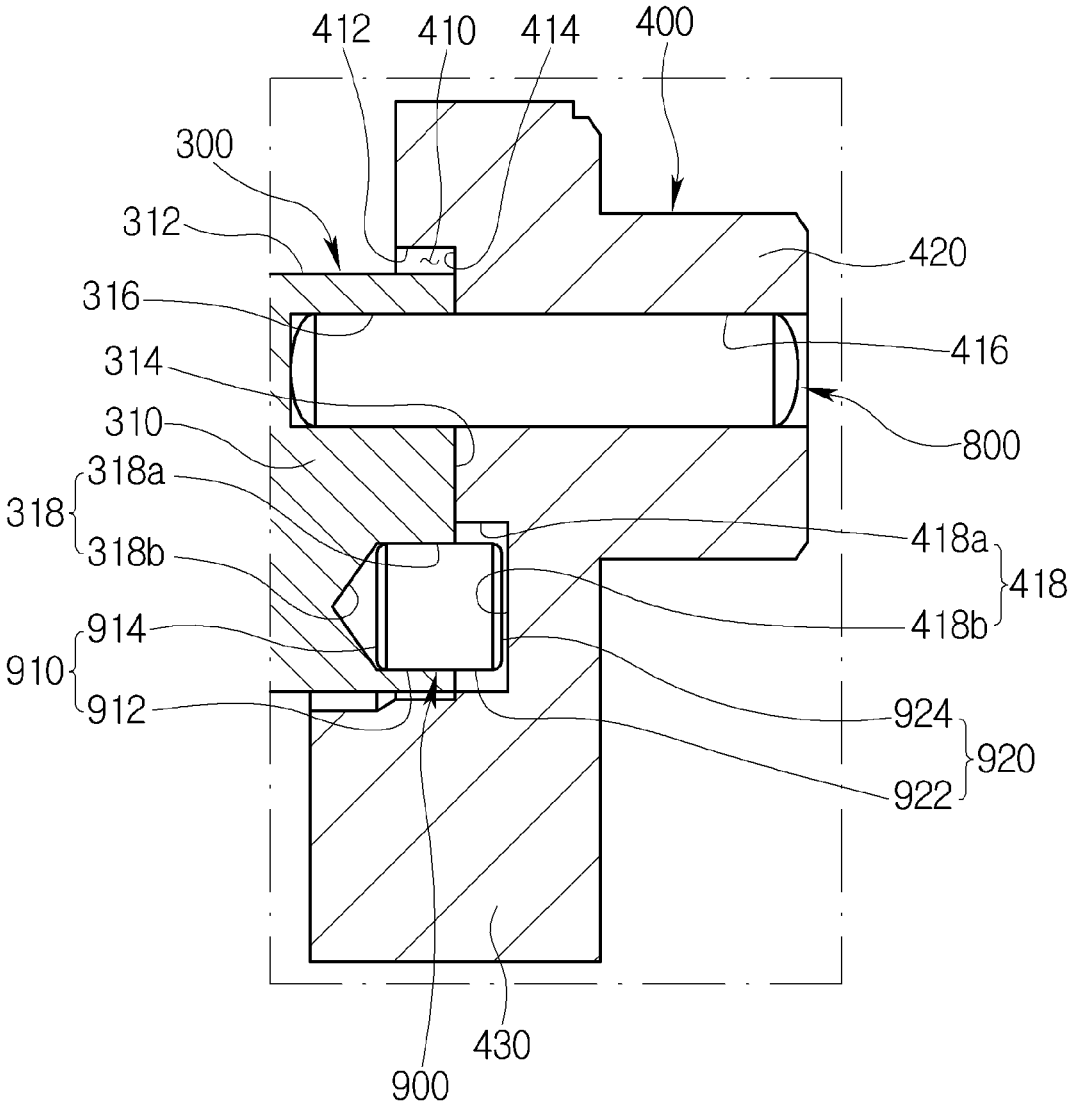
FIG. 8 is an enlarged cross-sectional view illustrating a shaft, an eccentric bush, and a buffer member in the scroll compressor of FIG. 7.
Figure 9:
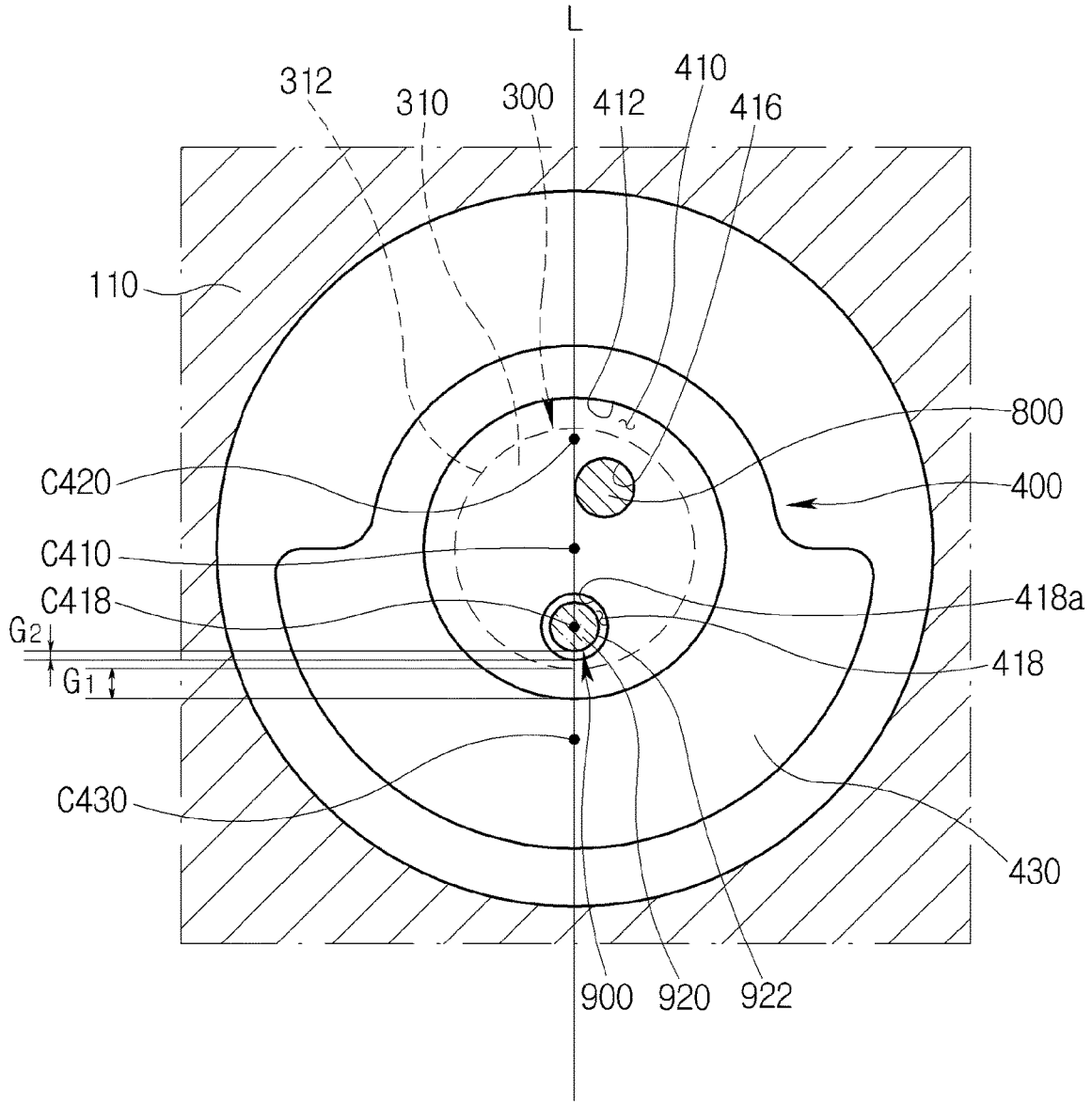
FIG. 9 is a cross-sectional view illustrating a positional relationship between the shaft, the eccentric bush, and the buffer member when the scroll compressor of FIG. 7 is normally operated.
Figure 10:
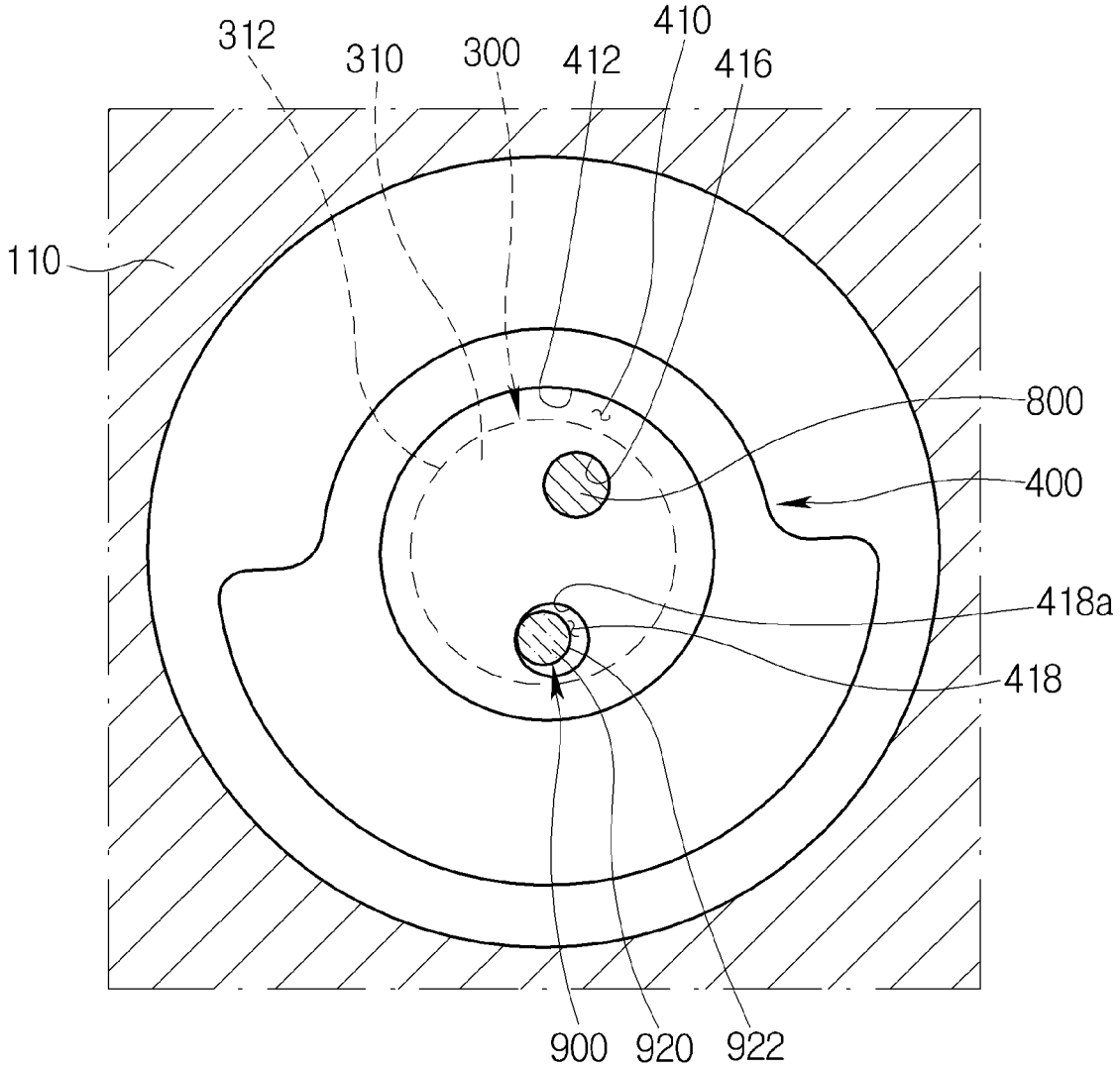
FIG. 10 is a cross-sectional view illustrating a state in which the eccentric bush of FIG. 9 is rotated about the shaft by the rotational clearance therebetween.
Figure 11:
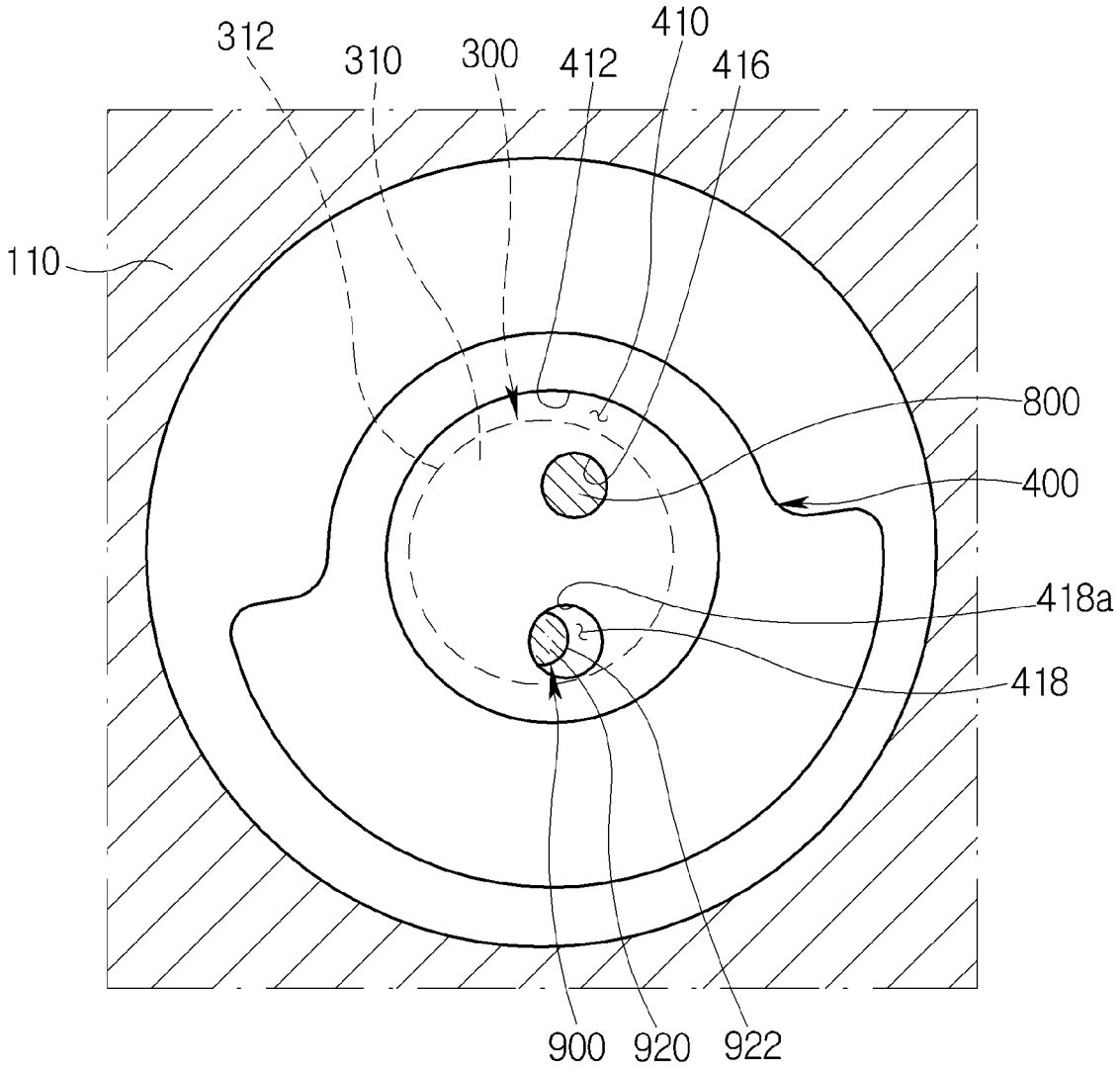
FIG. 11 is a cross-sectional view illustrating a state in which the eccentric bush of FIG. 10 is further rotated about the shaft by the rotational clearance therebetween.
Figure 12:
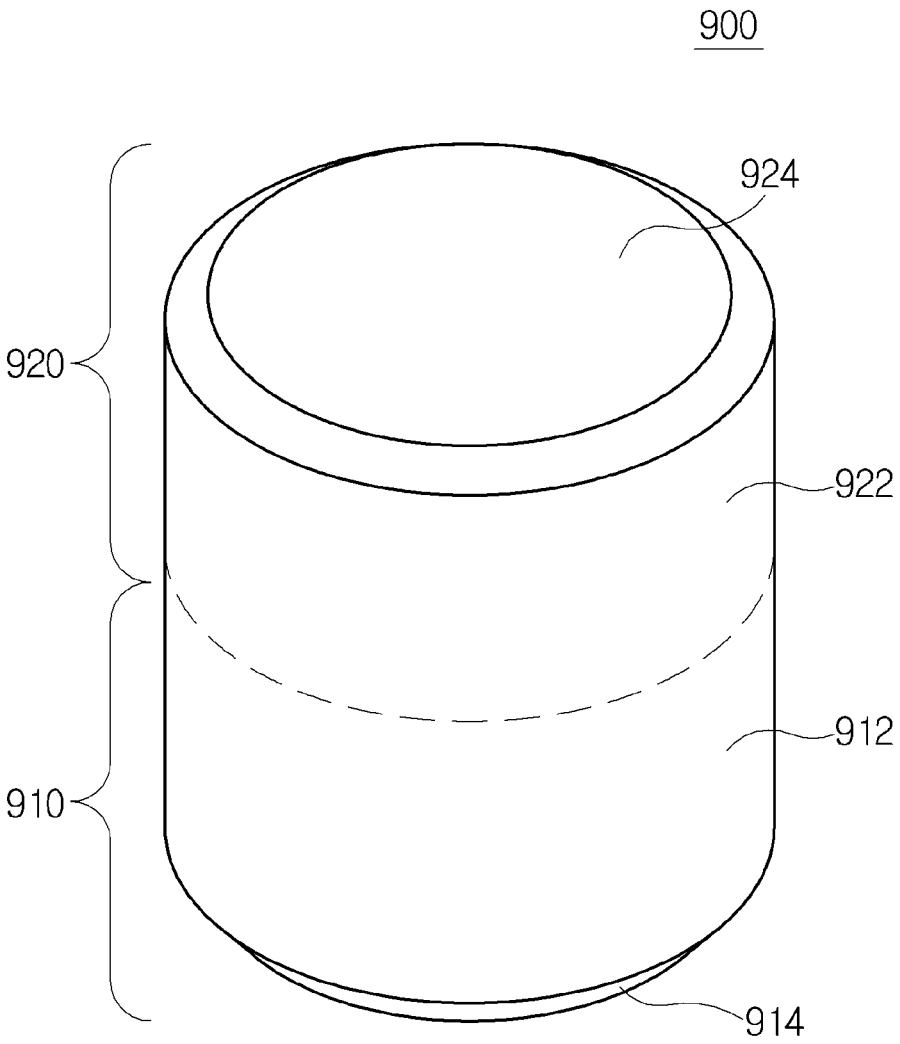
FIG. 12 is a perspective view illustrating the buffer member of FIGS. 9 and 10.
Figure 13:
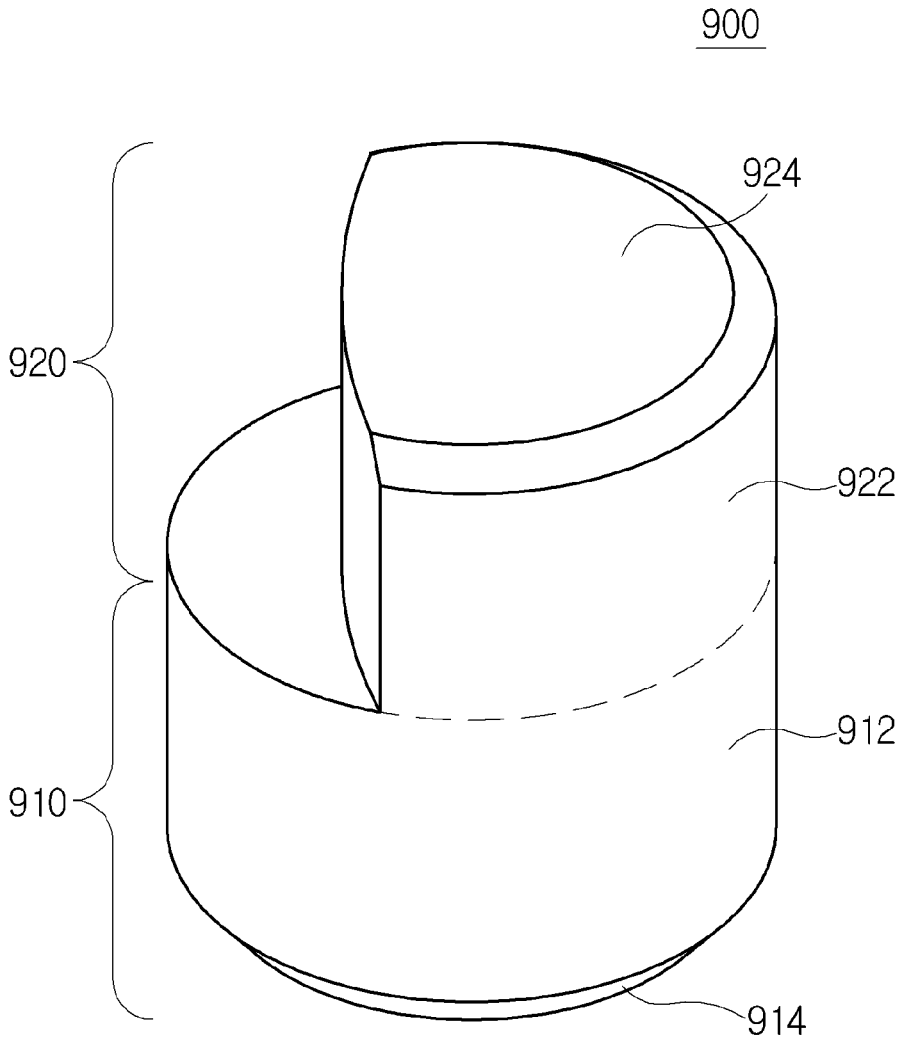
FIG. 13 is a perspective view illustrating the buffer member of FIG. 11.
Figure 14:
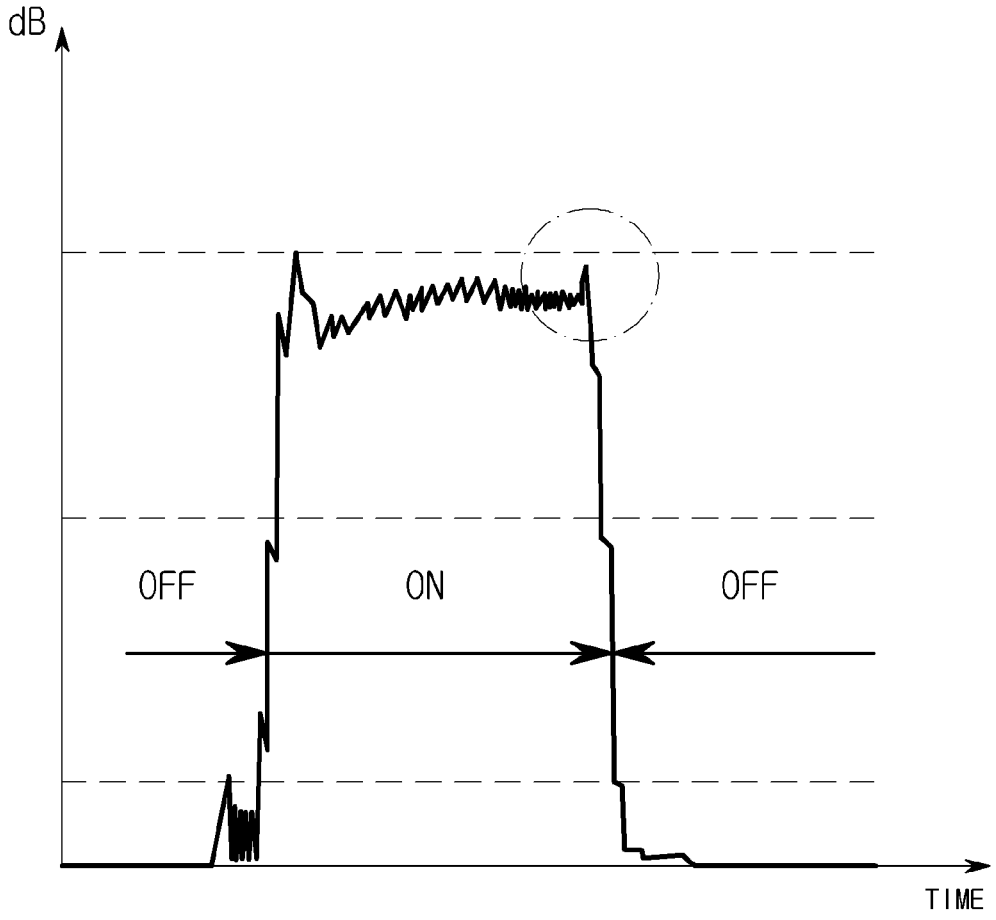
FIG. 14 is a graph illustrating noise measured in the scroll compressor of FIG. 7.

FIG. 7 is a cross-sectional view illustrating a scroll compressor according to an embodiment of the present disclosure. FIG. 8 is an enlarged cross-sectional view illustrating a shaft, an eccentric bush, and a buffer member in the scroll compressor of FIG. 7. FIG. 9 is a cross-sectional view illustrating a positional relationship between the shaft, the eccentric bush, and the buffer member when the scroll compressor of FIG. 7 is normally operated. FIG. 10 is a cross-sectional view illustrating a state in which the eccentric bush of FIG. 9 is rotated about the shaft by the rotational clearance therebetween. FIG. 11 is a cross-sectional view illustrating a state in which the eccentric bush of FIG. 10 is further rotated about the shaft by the rotational clearance therebetween. FIG. 12 is a perspective view illustrating the buffer member of FIGS. 9 and 10. FIG. 13 is a perspective view illustrating the buffer member of FIG. 11. FIG. 14 is a graph illustrating noise measured in the scroll compressor of FIG. 7.

Referring to FIGS. 7 to 14, the scroll compressor according to the embodiment of the present disclosure may include a casing 100, a drive source 200 provided in the casing 100 to generate a rotational force, a shaft 300 rotated by the drive source 200, an eccentric bush 400 for converting the rotational motion of the shaft 300 into an eccentric rotational motion, a orbiting scroll 500 operatively connected to the eccentric bush 400 for orbiting, and a fixed scroll 600 engaged with the orbiting scroll 500 to define a compression chamber together with the orbiting scroll 500.

The casing 100 may include a main frame 110 supporting the orbiting scroll 500.

The main frame 110 may have a bearing hole 112 through which the shaft 300 passes.

The bearing hole 112 may be formed with a bearing for rotatably supporting the shaft 300.

The main frame 110 may have an orbiting groove 114 in which the eccentric bush 400 orbits.

The orbiting groove 114 may be recessed from one surface of the main frame 110 facing the orbiting scroll 500 and may communicate with the bearing hole 112.

The drive source 200 may be a motor having a stator 210 and a rotor 220. The drive source 200 may also be formed as a disk hub assembly that is operatively connected to an engine of a vehicle.

The shaft 300 may have a cylindrical shape and extend in one direction. The eccentric bush 400 may be coupled to one end 310 of the shaft 300 and the rotor 220 may be coupled to the other end 320 of the shaft 300.

The eccentric bush 400 may include a recess 410 into which the one end 310 of the shaft 300 is inserted, an eccentric portion 420 that protrudes to the opposite side of the one end 310 of the shaft 300 with respect to the recess 410 and is eccentric to the shaft 300, and a balance weight 430 disposed on the opposite side of the eccentric portion 420 with respect to the recess 410 to balance the overall rotation of the eccentric bush 400.

The shaft 300 and the eccentric bush 400 may be configured such that a rotational clearance is present between an inner peripheral surface 412 of the recess 410 and an outer peripheral surface 312 of the one end 310 of the shaft 300, to prevent damage to the scrolls due to liquid refrigerant compression, for example, as in initial operation.

That is, the shaft 300 and the eccentric bush 400 may be coupled to each other so that they are rotatable relative to each other with respect to a position eccentric from the axis of rotation of the shaft 300.

Specifically, the one end 310 of the shaft 300 may be cylindrical in shape. That is, the outer peripheral surface 312 of the one end 310 of the shaft 300 may have a constant outer diameter, irrespective of the axial position of the shaft 300.

A hinge pin's one end insertion groove 316 may be formed on a tip surface 314 of the one end 310 of the shaft 300 so that one end of a hinge pin 800 for fastening the shaft 300 to the eccentric bush 400 is inserted into the hinge pin's one end insertion groove 316.

The center of the hinge pin's one end insertion groove 316 may be spaced apart from the axis of rotation of the shaft 300 in the radial direction of the shaft 300 such that the central axis of the hinge pin 800 is located at a position eccentric to the axis of rotation of the shaft 300.

The hinge pin 800 may have a cylindrical shape and extend in a direction parallel to the axial direction of the shaft 300. The hinge pin's one end insertion groove 316 may be cylindrically recessed while having an inner diameter equal to the outer diameter of the hinge pin 800 so as to correspond to the hinge pin 800.

The recess 410 of the eccentric bush 400 may be cylindrically recessed corresponding to the one end 310 of the shaft 300. That is, the inner peripheral surface 412 of the recess 410 may have a constant inner diameter, irrespective of the axial position of the recess 410.

The inner diameter of the recess 410 may be larger than the outer diameter of the one end 310 of the shaft 300 such that the eccentric bush 400 is rotatable relative to the shaft 300 about the hinge pin 800. That is, a gap G1 between the inner peripheral surface 412 of the recess 410 and the outer peripheral surface 312 of the one end 310 of the shaft 300 may be greater than zero (0). Here, the gap G1 between the inner peripheral surface 412 of the recess 410 and the outer peripheral surface 312 of the one end 310 of the shaft 300 is formed to be not less than a predetermined value so that the inner peripheral surface 412 of the recess 410 and the outer peripheral surface 312 of the one end 310 of the shaft 300 do not come into contact with each other, which will be described later.

A hinge pin's other end insertion groove 416 may be formed on a base surface 414 of the recess 410 facing the tip surface 314 of the one end 310 of the shaft 300 so that the other end of the hinge pin 800 is inserted into the hinge pin's other end insertion groove 416.

The center of the hinge pin's other end insertion groove 416 may be spaced apart from the central axis of the recess 410 in the radial direction of the recess 410 such that the central axis of the hinge pin 800 is located at a position eccentric to the central axis of the recess 410. The hinge pin's other end insertion groove 416 may be preferably formed at a position facing to the hinge pin's one end insertion groove 316 when the recess 410 is located at a position concentric with the one end 310 of the shaft 300 such that the eccentric bush 400 is rotatable relative to the shaft 300 in one direction and in a direction opposite thereto.

The hinge pin's other end insertion groove 416 may be cylindrically recessed while having an inner diameter equal to the outer diameter of the hinge pin 800 so as to correspond to the hinge pin 800.

Meanwhile, the scroll compressor according to the present embodiment may include a buffer member 900 interposed between the one end 310 of the shaft 300 and the recess 410 to prevent an impact sound from occurring by the eccentric bush 400 striking the shaft 300 due to the rotational clearance therebetween, for example, when rotation of the shaft 300 is interrupted. A buffer member's one end insertion groove 318 may be formed on the tip surface 314 of the one end 310 of the shaft 300 so that one end 910 of the buffer member 900 is inserted into the buffer member's one end insertion groove 318. A buffer member's other end insertion groove 418 may be formed on the base surface 414 of the recess 410 so that the other end 920 of the buffer member 900 is inserted into the buffer member's other end insertion groove 418. A rotational clearance may be present between an inner peripheral surface 418*a* of the buffer member's other end insertion groove 418 and an outer peripheral surface 922 of the other end 920 of the buffer member 900. The rotational clearance may allow the outer peripheral surface 922 of the other end 920 of the buffer member 900 to come into contact into the inner peripheral surface 418*a* of the buffer member's other end insertion groove 418 before the inner peripheral surface 412 of the recess 410 comes into contact with the outer peripheral surface 312 of the one end 310 of the shaft 300.

Specifically, the buffer member 900 may have a cylindrical shape and extend in one direction. That is, each of the outer peripheral surface 912 of the one end 910 of the buffer member 900 and the outer peripheral surface 922 of the other end 920 of the buffer member 900 may have a constant outer diameter, irrespective of the axial position of the buffer member 900.

The buffer member 900 may be made of a material (e.g., PTFE, plastic, or rubber) having an elastic modulus and Shore hardness smaller than the buffer member's one end insertion groove 318 and the buffer member's other end insertion groove 418. Thus, the outer peripheral surface 922 of the other end 920 of the buffer member 900 comes into contact with and is separated from the inner peripheral surface 418*a* of the buffer member's other end insertion groove 418 depending on the position of the eccentric bush 400 relative to the shaft 300 in the state in which the one end 910 of the buffer member 900 is fastened to the buffer member's one end insertion groove 318. In addition, the other end 920 of the buffer member 900 is deformed and restored while coming into contact with and being separated from the inner peripheral surface 418*a* of the buffer member's other end insertion groove 418.

The buffer member's one end insertion groove 318 may be cylindrical in shape so as to correspond to the one end 910 of the buffer member 900. That is, the inner peripheral surface 318*a* of the buffer member's one end insertion groove 318 may have a constant inner diameter, irrespective of the axial position of the buffer member's one end insertion groove 318.

The inner diameter of the buffer member's one end insertion groove 318 may be smaller than the outer diameter of the one end 910 of the buffer member 900 such that the one end 910 of the buffer member 900 is press-fitted into the buffer member's one end insertion groove 318.

The buffer member's other end insertion groove 418 may be cylindrical in shape so as to correspond to the other end 920 of the buffer member 900. That is, the inner peripheral surface 418*a* of the buffer member's other end insertion groove 418 may have a constant inner diameter, irrespective of the axial position of the buffer member's other end insertion groove 418.

A rotational clearance may be present between the inner peripheral surface 418*a* of the buffer member's other end insertion groove 418 and the outer peripheral surface 922 of the other end 920 of the buffer member 900 such that the outer peripheral surface 922 of the other end 920 of the buffer member 900 comes into contact with and is separated from the inner peripheral surface 418*a* of the buffer member's other end insertion groove 418 depending on the position of the eccentric bush 400 relative to the shaft 300. In other words, the inner diameter of the buffer member's other end insertion groove 418 may be larger than the outer diameter of the other end 920 of the buffer member 900 such that the other end 920 of the buffer member 900 is rotatable about the hinge pin 800 in the buffer member's other end insertion groove 418. That is, a gap G2 between the inner peripheral surface 418*a* of the buffer member's other end insertion groove 418 and the outer peripheral surface 922 of the other end 920 of the buffer member 900 may be greater than zero (0).

The gap G2 between the inner peripheral surface 418*a* of the buffer member's other end insertion groove 418 and the outer peripheral surface 922 of the other end 920 of the buffer member 900 may be formed to be smaller than a predetermined value so that the inner peripheral surface 412 of the recess 410 does not come into contact with the outer peripheral surface 312 of the one end 310 of the shaft 300 when the outer peripheral surface 922 of the other end 920 of the buffer member 900 comes into contact with the inner peripheral surface 418*a* of the buffer member's other end insertion groove 418. That is, on the basis of when the recess 410 is located at a position concentric with the one end 310 of the shaft 300, the gap G1 between the inner peripheral surface 412 of the recess 410 and the outer peripheral surface 312 of the one end 310 of the shaft 300 is constant and the gap G2 between the inner peripheral surface 418*a* of the buffer member's other end insertion groove 418 and the outer peripheral surface 922 of the other end 920 of the buffer member 900 is constant, on a certain plane perpendicular to the one end 310 of the shaft 300. In this case, the gap G2 between the inner peripheral surface 418*a* of the buffer member's other end insertion groove 418 and the outer peripheral surface 922 of the other end 920 of the buffer member 900 may be smaller than the gap G1 between the inner peripheral surface 412 of the recess 410 and the outer peripheral surface 312 of the one end 310 of the shaft 300.

Hereinafter, the operation and effect of the scroll compressor according to the present embodiment will be described.

When electric power is applied to the drive source 200, a series of processes may be repeated in which the shaft 300 is rotated together with the rotor 220, the orbiting scroll 500 is operatively connected to the shaft 300 through the eccentric bush 400 for orbiting, and a refrigerant is sucked into the compression chamber by the orbiting of the orbiting scroll 500, compressed in the compression chamber, and discharged from the compression chamber.

In the scroll compressor according to the present embodiment, the rotational clearance is formed between the shaft 300 and the eccentric bush 400 (more exactly, between the outer peripheral surface 312 of the one end 310 of the shaft 300 and the inner peripheral surface 412 of the recess 410). Thus, when the scroll compressor is normally operated, the eccentric bush 400 is rotated together with the shaft 300 in the state in which the recess 410 and the shaft 300 are concentric with each other, as illustrated in FIG. 9. However, for example, when a liquid refrigerant is present as in initial operation, the eccentric bush 400 may be rotated together with the shaft 300 in the state in which the eccentric bush 400 is rotated relative to the shaft 300 so that the radius of rotation of the eccentric bush 400 is adjusted, as illustrated in FIG. 10. That is, the rotational motion of the shaft 300 is not be immediately transmitted to the eccentric bush 400 but is transmitted thereto in a buffered manner according to the designed rotational clearance. Therefore, it is possible to prevent damage to the scrolls due to liquid refrigerant compression.

The buffer member 900 may be provided in such a manner that the one end 910 thereof is inserted into the buffer member's one end insertion groove 318 formed in the one end 310 of the shaft 300 and the other end 920 thereof is inserted into the buffer member's other end insertion groove 418 formed in the recess 410. The one end 910 of the buffer member 900 may be fixed into the buffer member's one end insertion groove 318 and the other end 920 of the buffer member 900 may move in the buffer member's other end insertion groove 418. On the basis of when the recess 410 is located at a position concentric with the one end 310 of the shaft 300, the gap G2 between the inner peripheral surface 418*a* of the buffer member's other end insertion groove 418 and the outer peripheral surface 922 of the other end 920 of the buffer member 900 is smaller than the gap G1 between the inner peripheral surface 412 of the recess 410 and the outer peripheral surface 312 of the one end 310 of the shaft 300, with the consequence that it is possible to prevent an impact sound between the shaft 300 and the eccentric bush 400. That is, when the eccentric bush 400 is rotated relative to the shaft 300, the inner peripheral surface 418*a* of the buffer member's other end insertion groove 418 comes into contact with the outer peripheral surface 922 of the other end 920 of the buffer member 900 before the inner peripheral surface 412 of the recess 410 comes into contact with the outer peripheral surface 312 of the one end 310 of the shaft 300, as illustrated in FIG. 10. When the eccentric bush 400 is further rotated relative to the shaft 300 from the state of FIG. 10, the other end 920 of the buffer member 900 restrains the rotation of the eccentric bush 400, with the consequence that it is possible to prevent the inner peripheral surface 412 of the recess 410 from striking the outer peripheral surface 312 of the one end 310 of the shaft 300, as illustrated in FIG. 11. Therefore, as illustrated in FIG. 14, it is possible to prevent an impact sound between the shaft 300 and the eccentric bush 400 and to improve the noise and vibration of the compressor.

Since the buffer member is made of a material having an elastic modulus and Shore hardness smaller than the buffer member's one end insertion groove 318 and the buffer member's other end insertion groove 418, it is possible to suppress noise and vibration due to the collision between the other end 920 of the buffer member 900 and the inner peripheral surface 418*a* of the buffer member's other end insertion groove 418 and to prevent damage to the buffer member's one end insertion groove 318 and the buffer member's other end insertion groove 418 while the other end 920 of the buffer member 900 is deformed and restored, as illustrated in FIGS. 10 to 13.

Meanwhile, if the elastic modulus and Shore hardness of the buffer member 900 are too small, the noise and vibration of the compressor may not be improved.

Specifically, if the elastic modulus and Shore hardness of the buffer member 900 are small, the other end 920 of the buffer member 900 may be relatively easily and greatly deformed when the eccentric bush 400 is further rotated relative to the shaft 300 from the state of FIG. 10.

Of course, the deformation and elastic restoring force of the buffer member 900 are proportional to each other. Therefore, as the deformation of the buffer member 900 increases, the force for restraining the rotation of the eccentric bush 400 increases. However, when the deformation of the buffer member 900 is insufficient and the elastic restoring force of the buffer member 900 is not enough to restrain the rotation of the eccentric bush 400 until the inner peripheral surface 412 of the recess 410 comes into contact with the outer peripheral surface of the shaft 300, the inner peripheral surface 412 of the recess 410 may strike the outer peripheral surface 312 of the one end 310 of the shaft 300.

In this regard, if the elastic modulus and Shore hardness of the buffer member 900 are small, it is necessary to form the gap G2 between the inner peripheral surface 418*a* of the buffer member's other end insertion groove 418 and the outer peripheral surface 922 of the other end 920 of the buffer member 900 to be significantly smaller than the gap G1 between the inner peripheral surface 412 of the recess 410 and the outer peripheral surface 312 of the one end 310 of the shaft 300, such that the deformation of the buffer member 900 is sufficient and the elastic restoring force of the buffer member 900 is enough to restrain the rotation of the eccentric bush 400 before the inner peripheral surface 412 of the recess 410 comes into contact with the outer peripheral surface 312 of the one end 310 of the shaft 300. That is, it is necessary to form the gap G2 between the inner peripheral surface 418*a* of the buffer member's other end insertion groove 418 and the outer peripheral surface 922 of the other end 920 of the buffer member 900 to be proportional to the elastic modulus and the Shore hardness of the buffer member 900.

Figure 15:
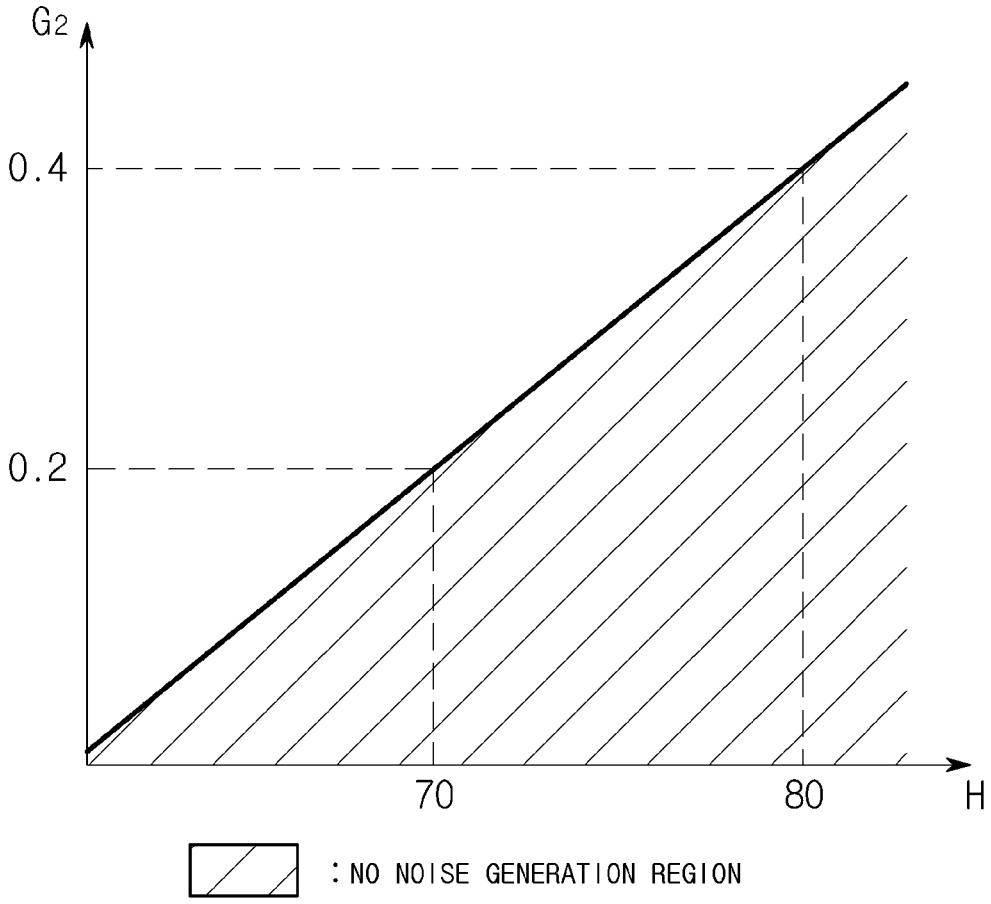
FIG. 15 is a graph illustrating whether a collision noise is generated between the shaft and the eccentric bush when adjusting the material of the buffer member and the gap between the buffer member and the eccentric bush in the scroll compressor of FIG. 7.

More specifically, referring to FIG. 15, it is tested whether a collision noise is generated between the shaft 300 and the eccentric bush 400 while adjusting the material (Shore hardness) of the buffer member 900 and the gap G2 between the inner peripheral surface 418*a* of the buffer member's other end insertion groove 418 and the outer peripheral surface 922 of the other end 920 of the buffer member 900. As a result, when $0<G2\leq$(0.02 mm/Shore hardness of 1 unit)*H−1.2 mm (hereinafter, referred to as a "first relation") is satisfied, it is determined that the collision noise between the shaft 300 and the eccentric bush 400 is not generated. Here, reference character H refers to the Shore hardness of the buffer member 900.

Accordingly, the material (Shore hardness) of the buffer member 900 and the gap G2 between the inner peripheral surface 418*a* of the buffer member's other end insertion groove 418 and the outer peripheral surface 922 of the other end 920 of the buffer member 900 must be formed to satisfy the first relation so that the collision noise between the shaft 300 and the eccentric bush 400 is not generated.

In terms of preventing the collision noise between the shaft 300 and the eccentric bush 400, the material (Shore hardness) of the buffer member 900 and the gap G2 between the inner peripheral surface 418*a* of the buffer member's other end insertion groove 418 and the outer peripheral surface 922 of the other end 920 of the buffer member 900 may be preferably formed to satisfy 0<G2<(0.02 mm/Shore hardness of 1 unit)*H−1.2 mm (hereinafter, referred to as a "second relation"). That is, when the second relation is satisfied (when the gap G2 between the inner peripheral surface 418*a* of the buffer member's other end insertion groove 418 and the outer peripheral surface 922 of the other end 920 of the buffer member 900 is very small), the deformation of the other end 920 of the buffer member 900 increases under the same condition. Therefore, the buffer member 900 can more reliably restrain the rotation of the eccentric bush 400.

However, the material (Shore hardness) of the buffer member 900 and the gap G2 between the inner peripheral surface 418*a* of the buffer member's other end insertion groove 418 and the outer peripheral surface 922 of the other end 920 of the buffer member 900 are formed to satisfy the second relation, the effect of preventing damage to the scrolls due to liquid refrigerant compression may be deteriorated. That is, it is easy to rotate the eccentric bush 400 relative to the shaft 300 only until the inner peripheral surface 418*a* of the buffer member's other end insertion groove 418 comes into contact with the outer peripheral surface 922 of the other end 920 of the buffer member 900, whereas it is difficult to rotate the eccentric bush 400 relative to the shaft 300 after the inner peripheral surface 418*a* of the buffer member's other end insertion groove 418 comes into contact with the outer peripheral surface 922 of the other end 920 of the buffer member 900. Hence, after the inner peripheral surface 418*a* of the buffer member's other end insertion groove 418 comes into contact with the outer peripheral surface 922 of the other end 920 of the buffer member 900, the effect of preventing damage to the scrolls due to liquid refrigerant compression may be deteriorated.

In this regard, the material (Shore hardness) of the buffer member 900 and the gap G2 between the inner peripheral surface 418*a* of the buffer member's other end insertion groove 418 and the outer peripheral surface 922 of the other end 920 of the buffer member 900 may be preferably formed to satisfy 0<G2=(0.02 mm/Shore hardness of 1 unit)*H−1.2 mm (hereinafter, referred to as a "third relation"). Thus, it is possible to prevent the collision noise between the shaft 300 and the eccentric bush 400 and to reduce the deterioration of the effect of preventing damage to the scrolls due to liquid refrigerant compression.

Meanwhile, when comprehensively considering the durability performance of the shaft 300, the eccentric bush 400, and the buffer member 900 or the like, the buffer member 900 may be preferably made of a material having a Shore hardness of 70 to 80 units.

Accordingly, comprehensively considering the above-mentioned features, it may be preferred that the buffer member 900 is made of a material having a Shore hardness of 70 units and the gap G2 between the inner peripheral surface 418*a* of the buffer member's other end insertion groove 418 and the outer peripheral surface 922 of the other end 920 of the buffer member 900 is 0.2 mm according to the third relation.

In addition, it may be preferred that the buffer member 900 is made of a material having a Shore hardness of 80 units and the gap G2 between the inner peripheral surface 418*a* of the buffer member's other end insertion groove 418 and the outer peripheral surface 922 of the other end 920 of the buffer member 900 is 0.4 mm according to the third relation.

In the present embodiment, since the buffer member's other end insertion groove 418 has a cylindrical shape (since the inner peripheral surface 418*a* of the buffer member's other end insertion groove 418 has a constant inner diameter, irrespective of the axial position of the buffer member's other end insertion groove 418), the buffer member 900 is deformed and restored as illustrated in FIGS. 12 and 13. However, damage may occur between the one end 910 and the other end 920 of the buffer member 900 due to a considerable shear stress applied between the one end 910 and the other end 920 of the buffer member 900.

Figure 16:
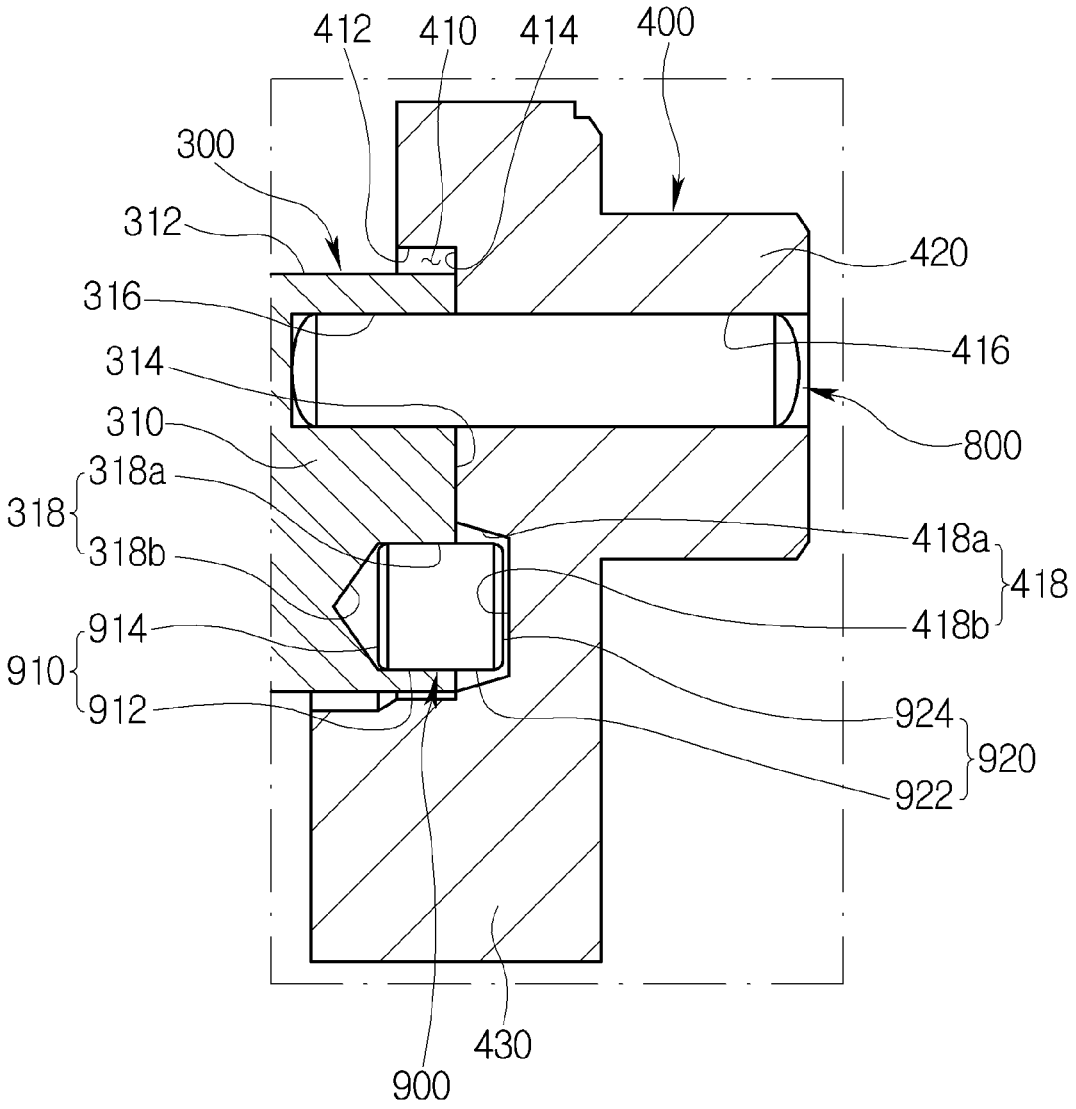
FIG. 16 is an enlarged cross-sectional view illustrating a shaft, an eccentric bush, and a buffer member in a scroll compressor according to another embodiment of the present disclosure.

In this regard, the buffer member's other end insertion groove 418 may have a conical shape as illustrated in FIG. 16. That is, the inner peripheral surface 418*a* of the buffer member's other end insertion groove 418 may have a decreasing inner diameter in the axial direction of the buffer member's other end insertion groove 418 from the tip surface 314 of the one end 310 of the shaft 300.

In this case, it may be preferable that the inner diameter of the inner peripheral surface 418*a* of the buffer member's other end insertion groove 418 is linearly decreased in the axial direction of the buffer member's other end insertion groove 418 from the tip surface 314 of the one end 310 of the shaft 300. Thus, the shear stress applied the other end 920 of the buffer member 900 is evenly distributed.

Figure 17:
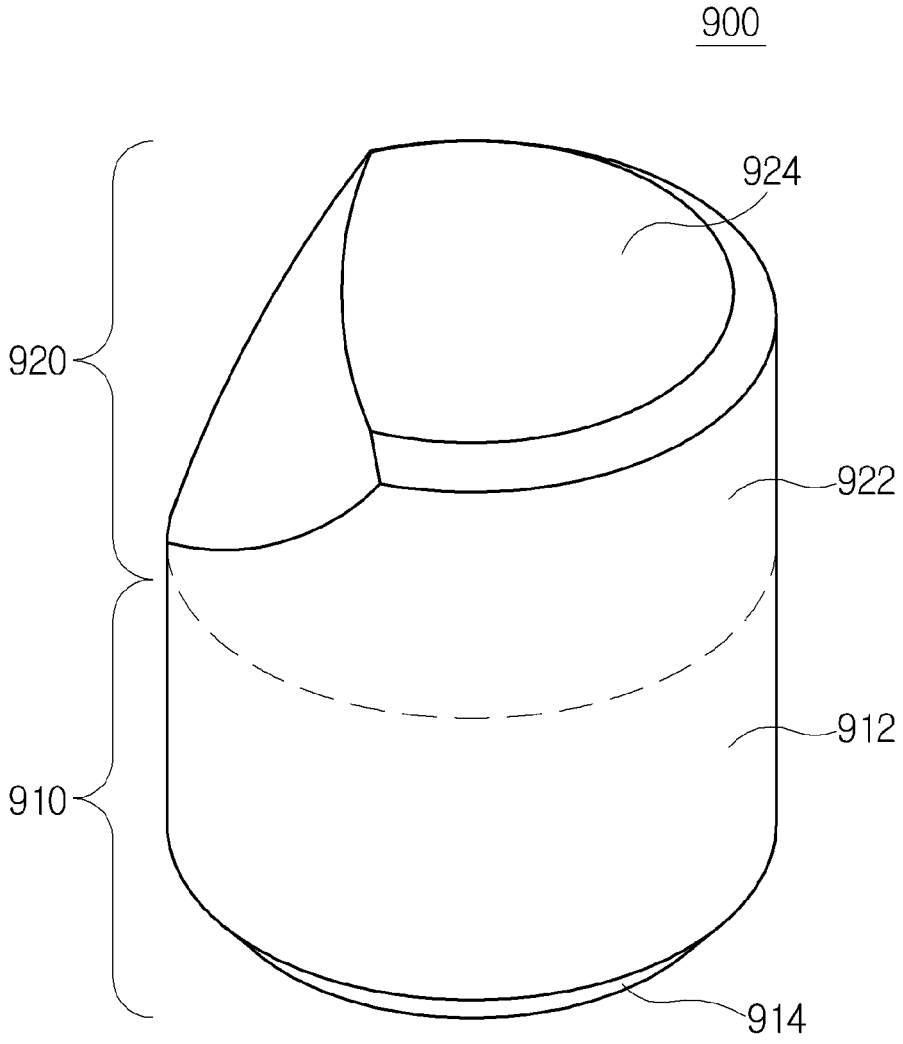
FIG. 17 is a perspective view illustrating a state in which the buffer member is deformed by the eccentric bush in the scroll compressor of FIG. 16.

When the other end 920 of the buffer member 900 is pressed into the buffer member's other end insertion groove 418, it is deformed as illustrated in FIG. 17 so that the shear stress applied the other end 920 of the buffer member 900 is reduced. Therefore, it is possible to suppress damage between the one end 910 and the other end 920 of the buffer member 900.

In the embodiment illustrated in FIGS. 16 and 17, the gap G2 between the inner peripheral surface 418*a* of the buffer member's other end insertion groove 418 and the outer peripheral surface 922 of the other end 920 of the buffer member 900 varies depending on the axial position of the buffer member's other end insertion groove 418. In order to prevent the collision noise between the shaft 300 and the eccentric bush 400, on the basis of when the recess 410 is located at a position concentric with the one end 310 of the shaft 300, the minimum gap G2 between the inner peripheral surface 418*a* of the buffer member's other end insertion groove 418 and the outer peripheral surface 922 of the other end 920 of the buffer member 900 may be smaller than the gap G1 between the inner peripheral surface 412 of the recess 410 and the outer peripheral surface 312 of the one end 310 of the shaft 300. That is, on the basis of a position of the outer peripheral surface 922 of the other end 920 of the buffer member 900 that is farthest from the tip surface 314 of the one end 310 of the shaft 300 in the axial direction, the gap G2 between the inner peripheral surface 418*a* of the buffer member's other end insertion groove 418 and the outer peripheral surface 922 of the other end 920 of the buffer member 900 may be smaller than the gap G1 between the inner peripheral surface 412 of the recess 410 and the outer peripheral surface 312 of the one end 310 of the shaft 300.

Meanwhile, when the tip surface 924 of the other end 920 of the buffer member 900 comes into contact with the base surface 418*b* of the buffer member's other end insertion groove 418, the buffer member 900 interferes with the rotation of the eccentric bush 400 relative to the shaft 300 even though the inner peripheral surface 418*a* of the buffer member's other end insertion groove 418 does not come into contact with the outer peripheral surface 922 of the other end 920 of the buffer member 900. Thus, it is advantageous in terms of reducing the collision noise between the shaft 300 and the eccentric bush 400, but it may be disadvantageous in terms of preventing damage to the scrolls due to liquid refrigerant compression.

In this regard, in the present embodiment, the tip surface 914 of the one end 910 of the buffer member 900 is spaced apart from the base surface 318*b* of the buffer member's one end insertion groove 318 and the tip surface 924 of the other end 920 of the buffer member 900 is spaced apart from the base surface 418*b* of the buffer member's other end insertion groove 418, as illustrated in FIGS. 7 and 8, such that the tip surface 924 of the other end 920 of the buffer member 900 does not come into contact with the base surface 418*b* of the buffer member's other end insertion groove 418 not only when the compressor is stopped (before the thermal expansion of the buffer member 900) but also when the compressor is operated (after the thermal expansion of the buffer member 900).

Unlike the present embodiment, the tip surface 914 of the one end 910 of the buffer member 900 may come into contact with the base surface 318*b* of the buffer member's one end insertion groove 318 and the tip surface 924 of the other end 920 of the buffer member 900 may be spaced apart from the base surface 418*b* of the buffer member's other end insertion groove 418. However, in order to more effectively prevent the tip surface 924 of the other end 920 of the buffer member 900 from coming into contact with the base surface 418*b* of the buffer member's other end insertion groove 418 by absorbing at least a portion of the tip surface 924 of the other end 920 of the buffer member 900 at the one end 910 of the buffer member 900 during the thermal expansion of the buffer member 900 to reduce the movement distance of the tip surface 924 of the other end 920 of the buffer member 900 to the base surface 418*b* of the buffer member's other end insertion groove 418 by the thermal expansion of the buffer member 900, the tip surface 914 of the one end 910 of the buffer member 900 may be preferably spaced apart from the base surface 318*b* of the buffer member's one end insertion groove 318 as in the present embodiment.

In the present embodiment, in order to prevent the separation of the buffer member 900 from the buffer member's one end insertion groove 318 by press-fitting the one end 910 of the buffer member 900 into the buffer member's one end insertion groove 318, each of the buffer member's one end insertion groove 318 and the one end 910 of the buffer member 900 has a cylindrical shape and the inner diameter of the one end 910 of the buffer member 900 is smaller than the outer diameter of the one end 910 of the buffer member 900.

However, in order to more effectively prevent the separation of the buffer member 900 from the buffer member's one end insertion groove 318 while the buffer member 900 is easily inserted into the buffer member's one end insertion groove 318, it may be preferable that the inner diameter of the buffer member's one end insertion groove 318 is equal to the outer diameter of the one end 910 of the buffer member and at least one of the inner peripheral surface 318*a* of the buffer member's one end insertion groove 318 and the outer peripheral surface 912 of the one end 910 of the buffer member 900 has an irregularity U formed thereon.

Figure 18:
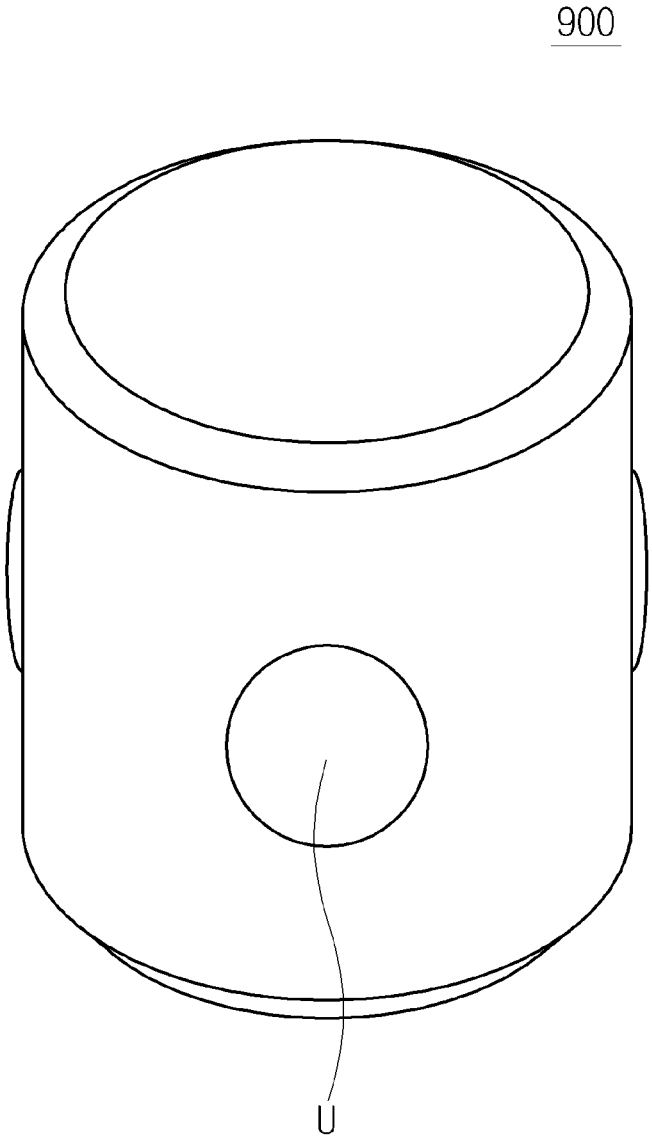
FIGS. 18 to 20 are perspective views illustrating a buffer member in a scroll compressor according to a further embodiment of the present disclosure.
Figure 19:
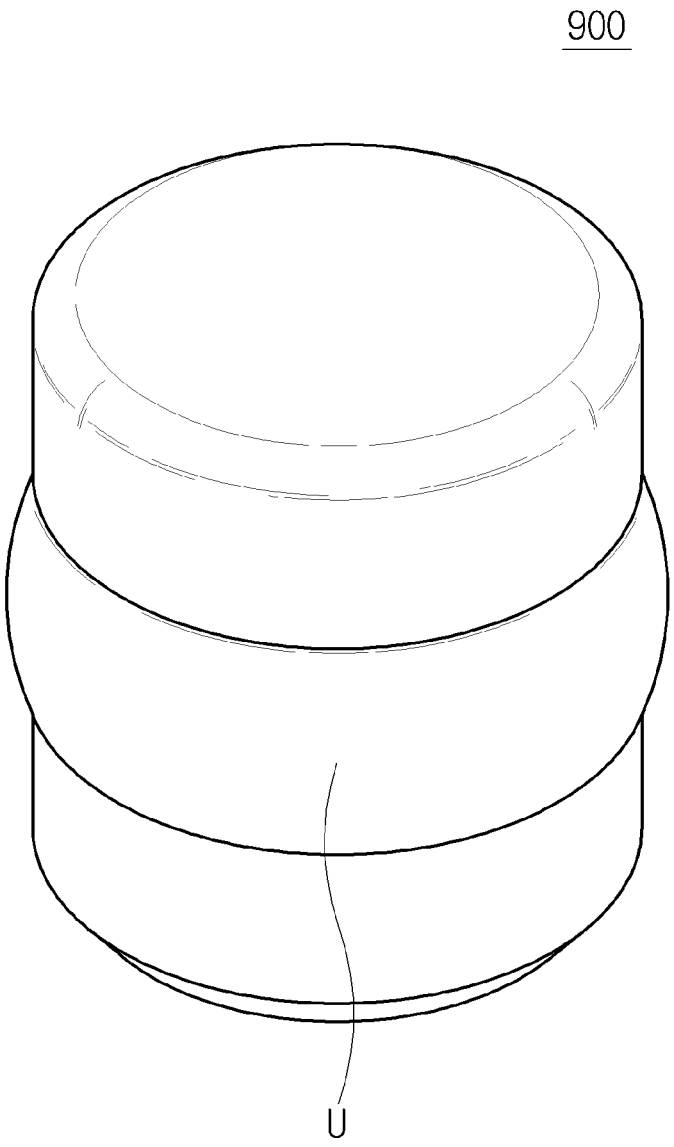
Figure 20:
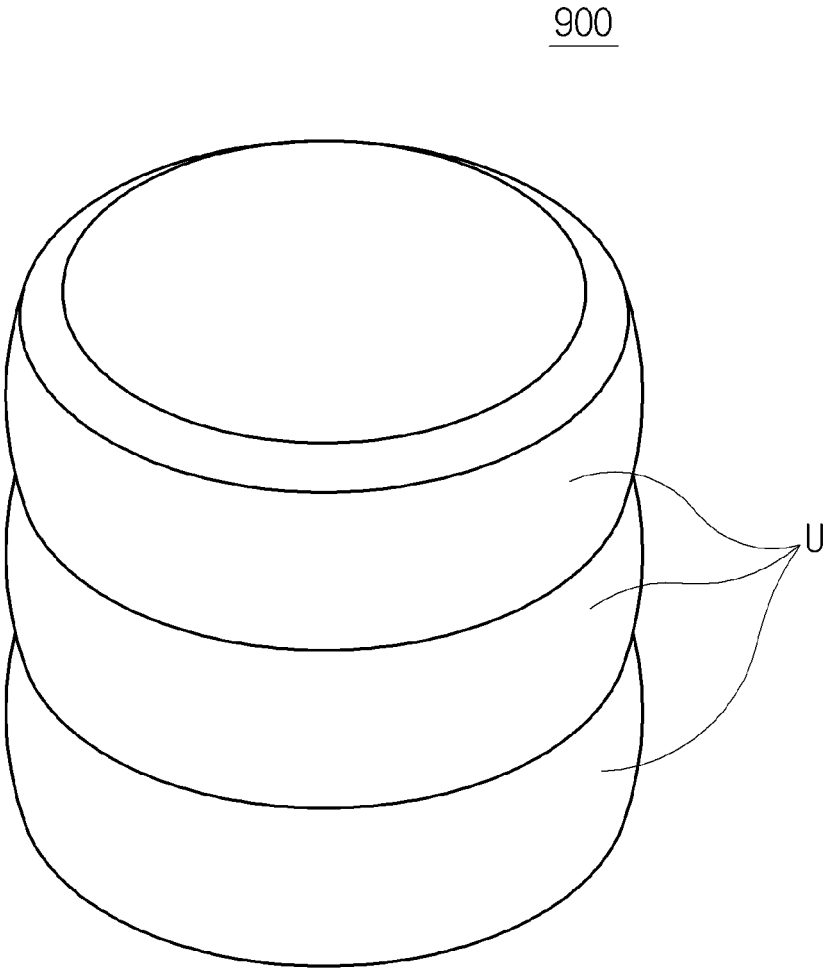

That is, as illustrated in FIGS. 18 to 20, the irregularity U may be, for example, a protrusion protruding from the outer peripheral surface 912 of the one end 910 of the buffer member 900.

In the embodiment illustrated in FIG. 18, the irregularity U may be a plurality of protrusions arranged in the circumferential direction of the buffer member 900. In the embodiment illustrated in FIG. 19, the irregularity U may be a single annular protrusion extending in the circumferential direction of the buffer member 900. In the embodiment illustrated in FIG. 20, the irregularity U may be a plurality of annular protrusions arranged in the axial direction of the buffer member 900.

The buffer member's other end insertion groove 418 may be formed at any position in the region of the recess 410. On the basis of when the recess 410 is located at a position concentric with the one end 310 of the shaft 300, the buffer member's one end insertion groove 318 may be formed to face the buffer member's other end insertion groove 418.

However, in order to improve the rotation balance, on an imaginary straight line L connecting a center C418 of the buffer member's other end insertion groove 418 to a center C410 of the recess 410 and a center of gravity C430 of the balance weight 430, the buffer member's other end insertion groove 418 may be preferably located between the center C410 of the recess 410 and the center of gravity C430 of the balance weight 430 as in the present embodiment.

In order to further improve the rotation balance, it may be preferable that the buffer member's other end insertion groove 418 may be formed symmetrically with respect to the center C418 of the buffer member's other end insertion groove 418 as in the present embodiment.

In order to further improve the rotation balance, on the basis of when the recess 410 is located at a position concentric with the one end 310 of the shaft 300, it may be preferable that the buffer member's one end insertion groove 318 faces the buffer member's other end insertion groove 418 and the buffer member's one end insertion groove 318 is formed symmetrically with respect to the center of the buffer member's one end insertion groove 318 while being concentric with the buffer member's other end insertion groove 418.

While the present disclosure has been described with respect to the specific embodiments, it will be apparent to those skilled in the art that various changes and modifications may be made without departing from the spirit and scope of the disclosure as defined in the following claims.

What is claimed is:

1. A scroll compressor comprising:

a shaft rotated by a drive source;

an eccentric bush having a recess, into which a first end of the shaft is inserted, and an eccentric portion eccentric to the shaft;

an orbiting scroll operatively connected to the eccentric portion for orbiting;

a fixed scroll engaged with the orbiting scroll; and a buffer member interposed between the first end of the shaft and the recess, wherein a buffer member's one end insertion groove is formed on a tip surface of the first end of the shaft so that a first end of the buffer member is inserted into the buffer member's one end insertion groove, wherein a buffer member's other end insertion groove is formed on a base surface of the recess facing the tip surface of the first end of the shaft so that a second end of the buffer member is inserted into the buffer member's other end insertion groove, wherein a clearance is present between an inner peripheral surface of the recess and an outer peripheral surface of the first end of the shaft and between an inner peripheral surface of the buffer member's other end insertion groove and an outer peripheral surface of the second end of the buffer member, and wherein the clearance allows the outer peripheral surface of the second end of the buffer member to come into contact with the inner peripheral surface of the buffer member's other end insertion groove before the inner peripheral surface of the recess comes into contact with the outer peripheral surface of the first end of the shaft.

2. The scroll compressor according to claim 1, wherein when the recess is located at a position concentric with the first end of the shaft, a gap between the inner peripheral surface of the recess and the outer peripheral surface of the first end of the shaft is constant, a gap between the inner peripheral surface of the buffer member's other end insertion groove and the outer peripheral surface of the second end of the buffer member is constant, and the gap between the inner peripheral surface of the buffer member's other end insertion groove and the outer peripheral surface of the second end of the buffer member is smaller than the gap between the inner peripheral surface of the recess and the outer peripheral surface of the first end of the shaft.

3. The scroll compressor according to claim 2, wherein the buffer member is made of a material having a Shore hardness smaller than the buffer member's one end insertion groove and the buffer member's other end insertion groove.

4. The scroll compressor according to claim 3, wherein the gap between the inner peripheral surface of the buffer member's other end insertion groove and the outer peripheral surface of the second end of the buffer member is formed in proportion to the Shore hardness of the buffer member.

5. The scroll compressor according to claim 4, wherein when assuming that the gap between the inner peripheral surface of the buffer member's other end insertion groove and the outer peripheral surface of the second end of the buffer member is G2 and the Shore hardness of the buffer member is H, they are formed to satisfy a relation of $0<G2\leq(0.02\text{ mm/Shore hardness of 1 unit})*H-1.2\text{ mm}$.

6. The scroll compressor according to claim 5, wherein:

the buffer member is made of a material having a Shore hardness of 70 units; and the gap between the inner peripheral surface of the buffer member's other end insertion groove and the outer peripheral surface of the second end of the buffer member is greater than zero (0) and less than or equal to 0.2 mm.

7. The scroll compressor according to claim 5, wherein:

the buffer member is made of a material having a Shore hardness of 80 units; and the gap between the inner peripheral surface of the buffer member's other end insertion groove and the outer peripheral surface of the second end of the buffer member is greater than zero (0) and less than or equal to 0.4 mm.

8. The scroll compressor according to claim 1, wherein:

the inner peripheral surface of the buffer member's other end insertion groove has a decreasing inner diameter in an axial direction from the tip surface of the first end of the shaft; and when the recess is located at a position concentric with the first end of the shaft, a gap between the inner peripheral surface of the recess and the outer peripheral surface of the first end of the shaft is constant, a gap between the inner peripheral surface of the buffer member's other end insertion groove and the outer peripheral surface of the second end of the buffer member is constant, and a minimum gap between the inner peripheral surface of the buffer member's other end insertion groove and the outer peripheral surface of the second end of the buffer member is smaller than the gap between the inner peripheral surface of the recess and the outer peripheral surface of the first end of the shaft.

9. The scroll compressor according to claim 8, wherein the inner diameter of the inner peripheral surface of the buffer member's other end insertion groove is linearly decreased in the axial direction from the tip surface of the first end of the shaft.

10. The scroll compressor according to claim 1, wherein a tip surface of the second end of the buffer member is spaced apart from a base surface of the buffer member's other end insertion groove.

11. The scroll compressor according to claim 10, wherein a tip surface of the first end of the buffer member is spaced apart from a base surface of the buffer member's one end insertion groove.

12. The scroll compressor according to claim 1, wherein at least one of an inner peripheral surface of the buffer member's one end insertion groove and an outer peripheral surface of the first end of the buffer member has an irregularity formed thereon to prevent separation of the buffer member from the buffer member's one end insertion groove.

13. The scroll compressor according to claim 1, wherein:

the eccentric bush further comprises a balance weight disposed on an opposite side of the eccentric portion with respect to the recess;

a center of gravity of the balance weight is formed on an opposite side of a center of the eccentric portion with respect to a center of the recess; and on an imaginary straight line connecting a center of the buffer member's other end insertion groove to the center of the recess and the center of gravity of the balance weight, the buffer member's other end insertion groove is located between the center of the recess and the center of gravity of the balance weight.

14. The scroll compressor according to claim 13, wherein the buffer member's other end insertion groove is formed symmetrically with respect to the center of the buffer member's other end insertion groove.

15. The scroll compressor according to claim 13, wherein when the recess is located at a position concentric with the first end of the shaft, the buffer member's one end insertion groove faces the buffer member's other end insertion groove and the buffer member's one end insertion groove is formed symmetrically with respect to a center of the buffer member's one end insertion groove.

* * * * *